US008080147B2

(12) United States Patent
Sato

(10) Patent No.: US 8,080,147 B2
(45) Date of Patent: Dec. 20, 2011

(54) ELECTROLYTIC PLATING METHOD AND SEMICONDUCTOR DEVICE MANUFACTURING METHOD

(75) Inventor: Motonobu Sato, Kawasaki (JP)

(73) Assignee: Fujitsu Semiconductor Limited, Yokohama (JP)

( * ) Notice: Subject to any disclaimer, the term of this patent is extended or adjusted under 35 U.S.C. 154(b) by 514 days.

(21) Appl. No.: 12/361,936

(22) Filed: Jan. 29, 2009

(65) Prior Publication Data

US 2009/0283413 A1 Nov. 19, 2009

(30) Foreign Application Priority Data

May 13, 2008 (JP) ..... 2008-125882

(51) Int. Cl.
*C25D 5/02* (2006.01)
*C25D 5/00* (2006.01)
*C25D 5/12* (2006.01)

(52) U.S. Cl. ..... 205/123; 205/137; 205/157

(58) Field of Classification Search ..... 205/123, 205/137, 157; 204/199, 212
See application file for complete search history.

(56) References Cited

U.S. PATENT DOCUMENTS 6,551,487 B1 * 4/2003 Reid et al. ..... 205/137

FOREIGN PATENT DOCUMENTS

| | | | |
|---|---|---|---|
| JP | 2001-181895 | A | 7/2001 |
| JP | 2002-115097 | A | 4/2002 |
| JP | 2004-315889 | A | 11/2004 |

* cited by examiner

*Primary Examiner* — Luan Van

(74) *Attorney, Agent, or Firm* — Westerman, Hattori, Daniels & Adrian, LLP

(57) ABSTRACT

A disclosed electrolytic plating method includes a first step of immersing a substrate in electrolytic plating liquid including copper salt to form a first Cu layer on the substrate; and a second step of forming a second Cu layer over the first Cu layer. The first step is continued for ten seconds or less after the immersion. In the first step, the substrate is rotated at a first speed N (rpm) which satisfies $D \times N \times \pi \leqq 6000 \times \pi$ (mm/min), where D is the diameter of the substrate (mm), and $D \times N \times \pi$ represents the peripheral speed of the substrate, and a current is supplied to the substrate at a first density of 10 mA/cm$^2$ or less. In the second step, the substrate is rotated at a second speed higher than the first speed, and the current is supplied to the substrate at a second density higher than the first density.

9 Claims, 40 Drawing Sheets

ELECTROLYTIC PLATING METHOD AND SEMICONDUCTOR DEVICE MANUFACTURING METHOD

CROSS-REFERENCE TO RELATED APPLICATIONS

This application is based upon and claims the benefit of priority of Japanese Patent Application 2008-125882, filed on May 13, 2008, the entire contents of which are hereby incorporated herein by reference.

FIELD

The disclosures herein are directed to a semiconductor device, and in particular to a method for manufacturing a semiconductor device which includes an electrolytic plating process.

BACKGROUND

In ultrafine semiconductor integrated circuit devices today, a multilayer wiring structure having wiring patterns of a low resistance metal material is employed in order to interconnect numerous discrete semiconductor devices formed on a substrate. In particular, for a multilayer wiring structure having copper (Cu) wiring patterns, a damascene technique or a dual damascene technique is generally used in which wiring trenches or vias are formed in advance in a silicon oxide film, or in an interlayer dielectric film made of a so-called low-permittivity (low-K) material whose relative permittivity is lower than silicon oxide. According to the damascene or dual damascene technique, the wiring trenches or vias are filled with a Cu layer having low resistivity and high electromigration resistance, and excess Cu is removed by chemical mechanical polishing (CMP).

In the damascene or dual damascene technique, the surface of the wiring trenches or the vias formed in the interlayer dielectric film is generally covered by a barrier metal film typically made of a metal with a high melting point (e.g. Ta), or a nitride of such a metal (e.g. TaN). Subsequently, a thin Cu seed layer is formed by physical vapor deposition (PVD) or chemical vapor deposition (CVD). Then, using electrolytic plating with the Cu seed layer serving as an electrode, the wiring trenches or vias are filled with a Cu layer.

In the Cu-layer electrolytic plating process, an electrolytic plating solution is commonly used, such as a cupric sulfate aqueous solution in which copper salt (e.g. copper sulfate) is dissolved in a polar solvent (e.g. water).

FIGS. 1A through 1E illustrate a process for forming a Cu wiring pattern according to a typical damascene technique.

According to FIG. 1A, depressions 12 serving as wiring trenches or vias are formed in a dielectric film 11. Next, as illustrated in FIG. 1B, a barrier metal film 13 is formed on the bottom and sidewalls of each depression 12, as well as on the top-field surface of the dielectric film 11, in a manner so as to follow the shapes of the depressions 12. The barrier metal film 13 is typically made of a high-melting-point metal, such as Ta or Ti, or a conductive nitride of such a metal, such as TaN or TiN, for example.

According to FIG. 1C, a Cu seed layer 14 is deposited on the barrier metal film 13 by PVD or CVD in a manner so as to follow the shapes of the depressions 12. As illustrated in FIG. 1D, by electrolytic plating with the Cu seed layer 14 serving as an electrode, the depressions 12 are filled with a Cu layer 15. The Cu layer 15 formed in this manner is also deposited on the top-field surface (flat parts) to form overgrowth regions commonly called "overplating".

According to FIG. 1E, the overplating of the Cu layer 15 covering the surface of the interlayer dielectric film 11 and the barrier metal film 13 disposed under the overplating is removed by CMP so that the interlayer dielectric film 11 is exposed. Herewith, Cu wiring pattern portions 15A are obtained, which have few voids and high resistance against stress migration and electromigration.

However, in the recent manufacture of semiconductor devices having line-and-space patterns with a line width of 0.16 μm or less or vias with a diameter of 0.16 μm or less, the problem remains that, after the electrolytic plating process of FIG. 1D, unevenness in the in-plane distribution of the overplating increases at the periphery of a wafer W, which is an in-process substrate. If this unevenness is large, when subsequently the wafer W is polished by CMP, variation in the degree of so-called dishing increases. This then leads to variation in the wiring height and resistance within the formed Cu wiring layer, which in turn results in variation in the characteristics of the semiconductor devices.

SUMMARY

According to an aspect of the present disclosure, an electrolytic plating method includes a first layer forming step of immersing an in-process substrate in an electrolytic plating liquid including copper salt to form a first copper layer on the in-process substrate; and a second layer forming step of forming a second copper layer over the first copper layer in the electrolytic plating liquid. The first layer forming step is continued for ten seconds or less after the immersion of the in-process substrate. In the first layer forming step, the in-process substrate is rotated at a first rotational speed N in rpm which satisfies a condition of $D \times N \times \pi \leqq 6000 \times \pi$ (mm/min), where D is the diameter of the in-process substrate in mm, and $D \times N \times \pi$ represents the peripheral speed of the in-process substrate, and a plating current is supplied to the in-process substrate at a first current density of 10 mA/cm$^2$ or less. In the second layer forming step, the in-process substrate is rotated at a second rotational speed which is higher than the first rotational speed, and the plating current is supplied to the in-process substrate at a second current density which is higher than the first current density.

Additional objects and advantages of the embodiment will be set forth in part in the description which follows, and in part will be obvious from the description, or may be learned by practice of the present disclosure. The object and advantages of the present disclosure will be realized and attained by means of the elements and combinations particularly pointed out in the appended claims.

It is to be understood that both the foregoing general description and the following detailed description are exemplary and explanatory only and are not restrictive of the present disclosure as claimed.

DESCRIPTION OF EMBODIMENTS

Embodiments that describe the best mode for carrying out the present disclosure are explained next with reference to the drawings.

(a) First Embodiment

Figure 2:
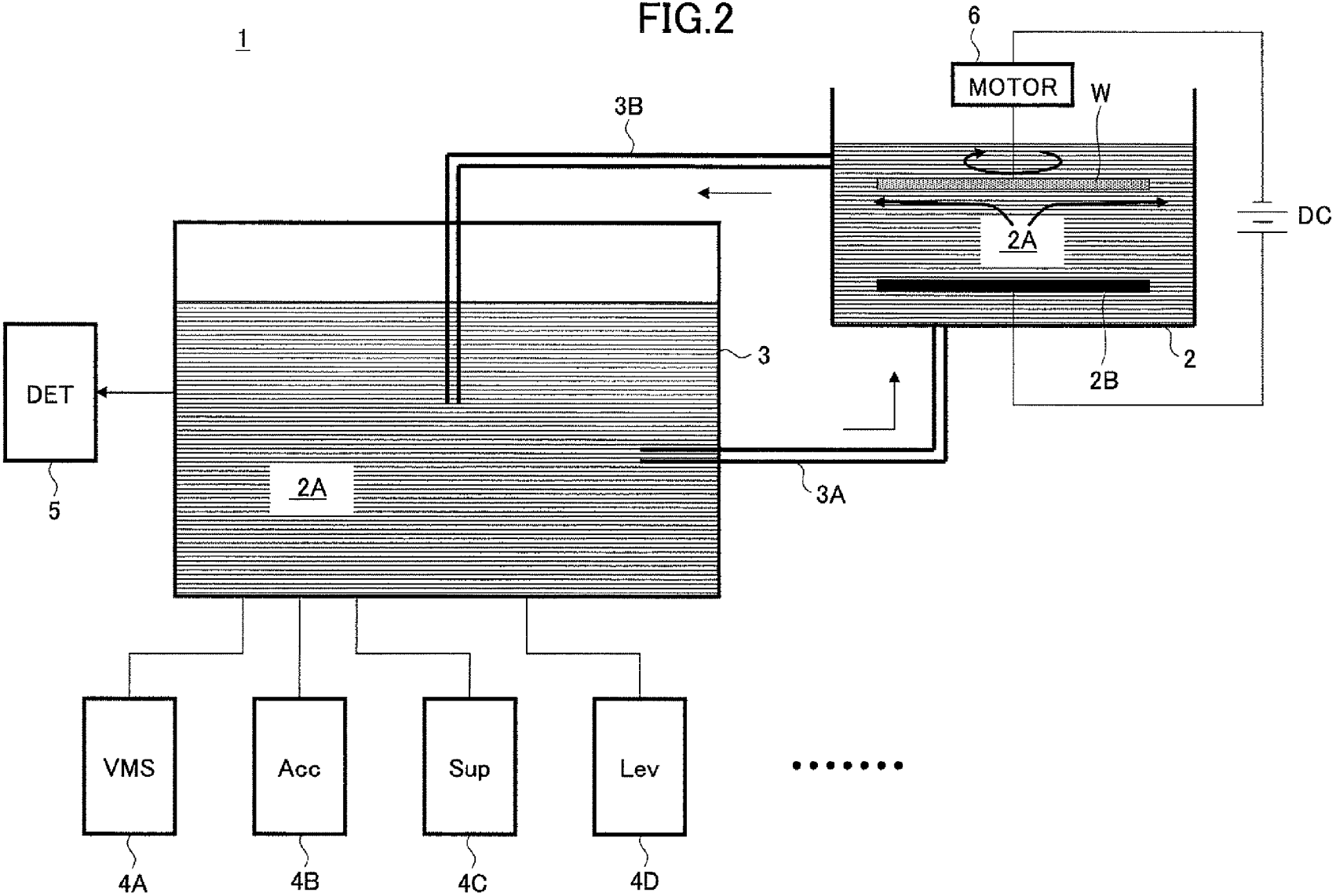
FIG. 2 shows a structure of an electrolytic plating apparatus used in the first embodiment.

FIG. 2 shows a schematic structure of an electrolytic plating apparatus 1 used in the first embodiment.

With reference to FIG. 2, the electrolytic plating apparatus 1 includes a container 2 in which an anode 2B is disposed in an electrolytic plating solution 2A. An in-process substrate W is immersed in the electrolytic plating solution 2A.

To the container 2, a tank 3 is connected via pipes 3A and 3B. The electrolytic plating solution 2A circulates between the container 2 and the tank 3 through the pipes 3A and 3B.

To the tank 3, the following units are connected via individual lines: a unit 4A that supplies Virgin Make-up Solution (VMS), which is chiefly a cupric sulfate aqueous solution; a unit 4B that supplies an accelerator (also referred to as "brightener" or "brightening agent") commonly made of a sulfur compound; a unit 4C that supplies a suppressor (also referred to as "inhibitor") made of polymer materials, such as polyethylene glycol and polypropylene glycol, having a molecular weight of about 1000 to 6000; and a unit 4D that supplies a leveler made of polymer materials having a molecular weight of more than 10000 and largely having a circular structure. A concentration measuring instrument 5 is also connected to the tank 3 in order to measure the concentration of the electrolytic plating solution 2A in the tank 3. In addition, during the electrolytic plating process, a direct-current power source DC is connected to the in-process substrate W and the anode 2B.

In the electrolytic plating apparatus 1, the in-process substrate W is rotated by a motor 6 while being immersed in the electrolytic plating solution 2A.

Figure 3:
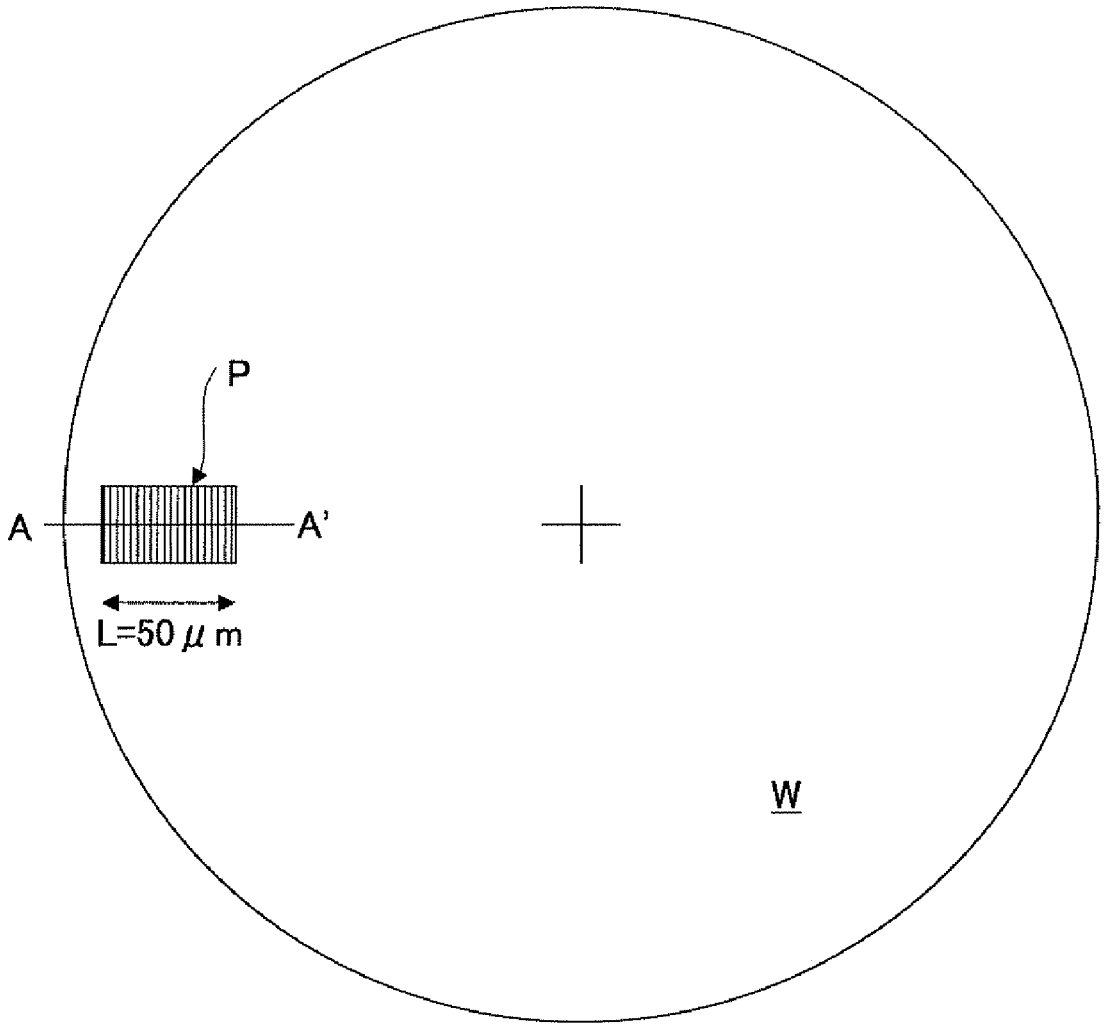
FIG. 3 illustrates a problem to be solved by the first embodiment.
Figure 4A:
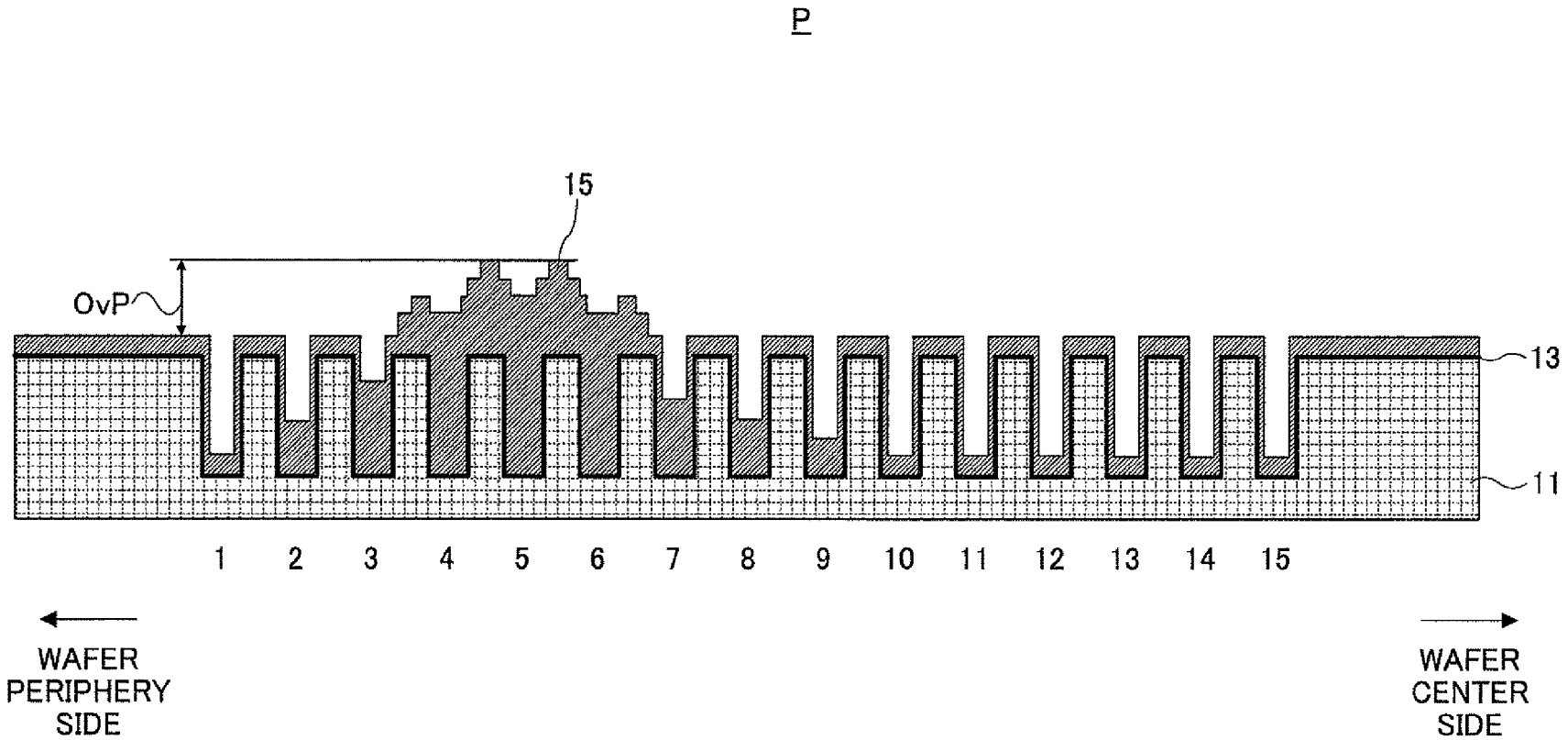
FIGS. 4A to 4B illustrate a problem to be solved by the first embodiment.
Figure 4B:
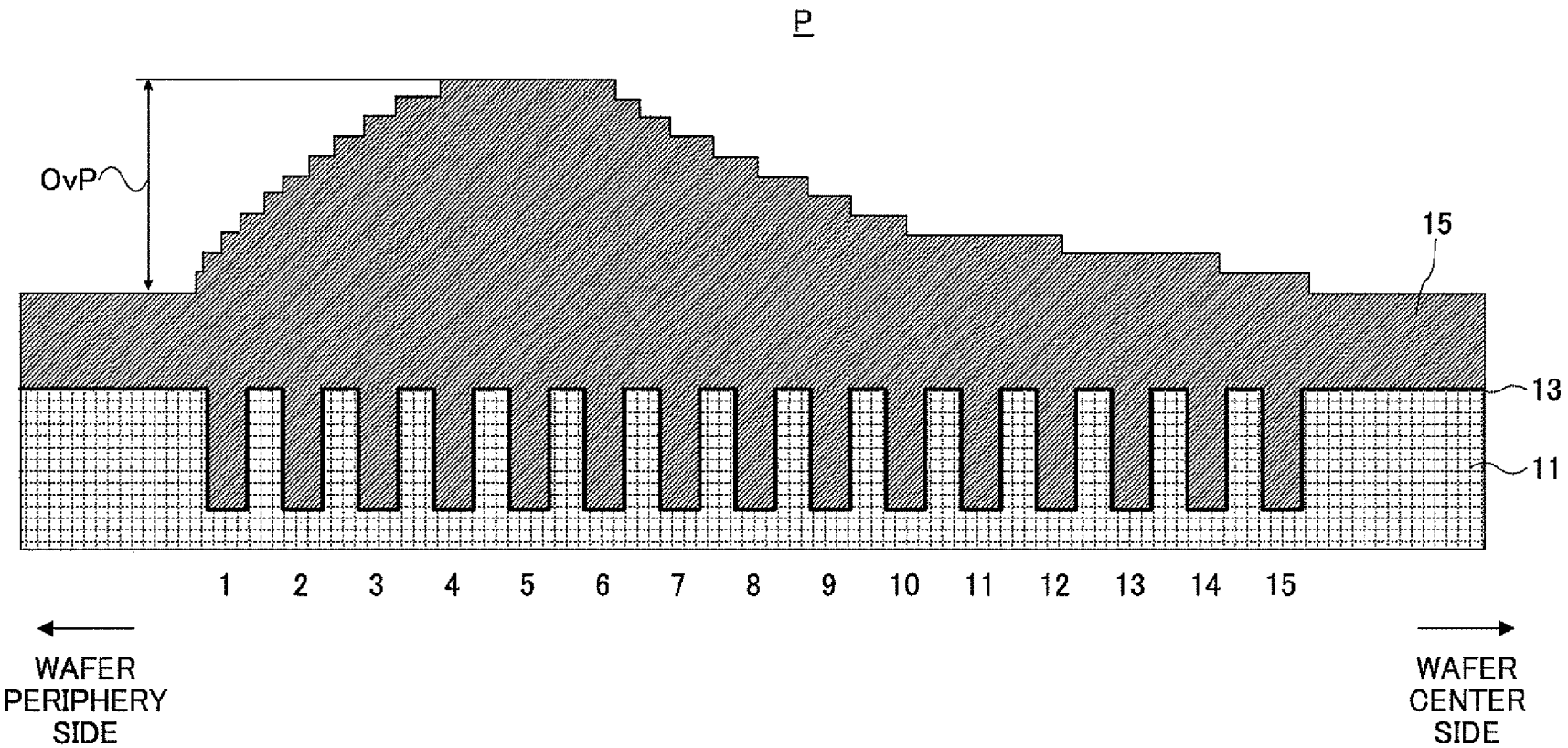
Figure 5:
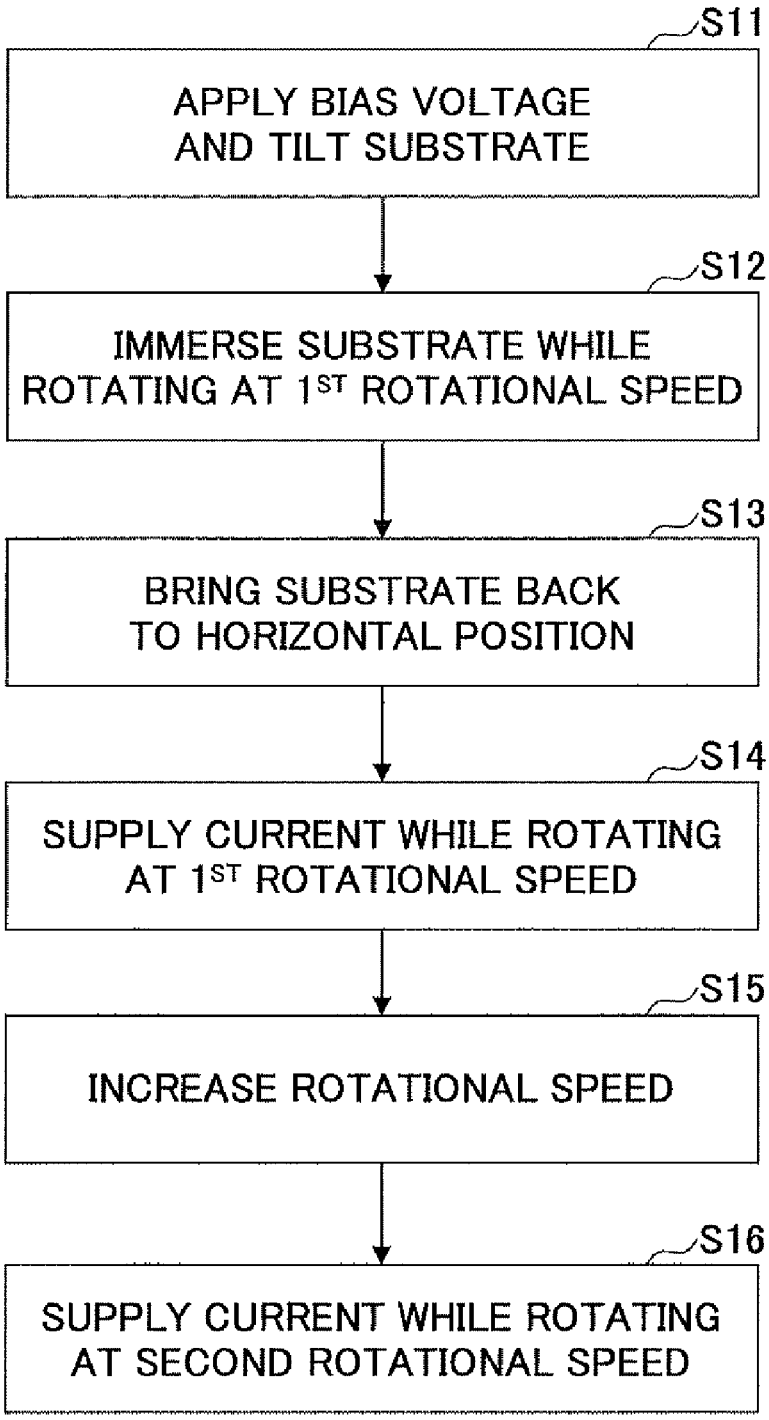
FIG. 5 illustrates a basis of the first embodiment.

FIGS. 3, 4A and 4B illustrate an experiment conducted by the inventors of the present application in a study which has formed the foundation of the present disclosure. The experiment relates to the process of FIG. 1D in which a line-and-space pattern (0.16 μm in line width and 0.12 μm in space width) P is filled with the Cu layer 15. Specifically, FIG. 3 is a plan view of the in-process substrate W, and FIGS. 4A and 4B are cross-sectional views along the line A-A' of FIG. 3. In the experiment, a silicon wafer having a diameter of 300 mm is used as the in-process substrate W. FIGS. 4A and 4B depict deposition of the Cu layer 15 over the line-and-space pattern P (50 μm in size L in the radial direction) disposed on the silicon wafer at 15 mm away from the periphery, with FIG. 4A illustrating the initial stage, 10 seconds after immersion of the in-process substrate W into the electrolytic plating solution 2A, and FIG. 4B illustrating the subsequent stage, i.e. after the initial stage until the completion of the formation of the Cu layer 15. FIG. 5 is a flowchart of the experiment of FIGS. 3, 4A and 4B corresponding to the process of FIG. 1D.

Figure 1A:
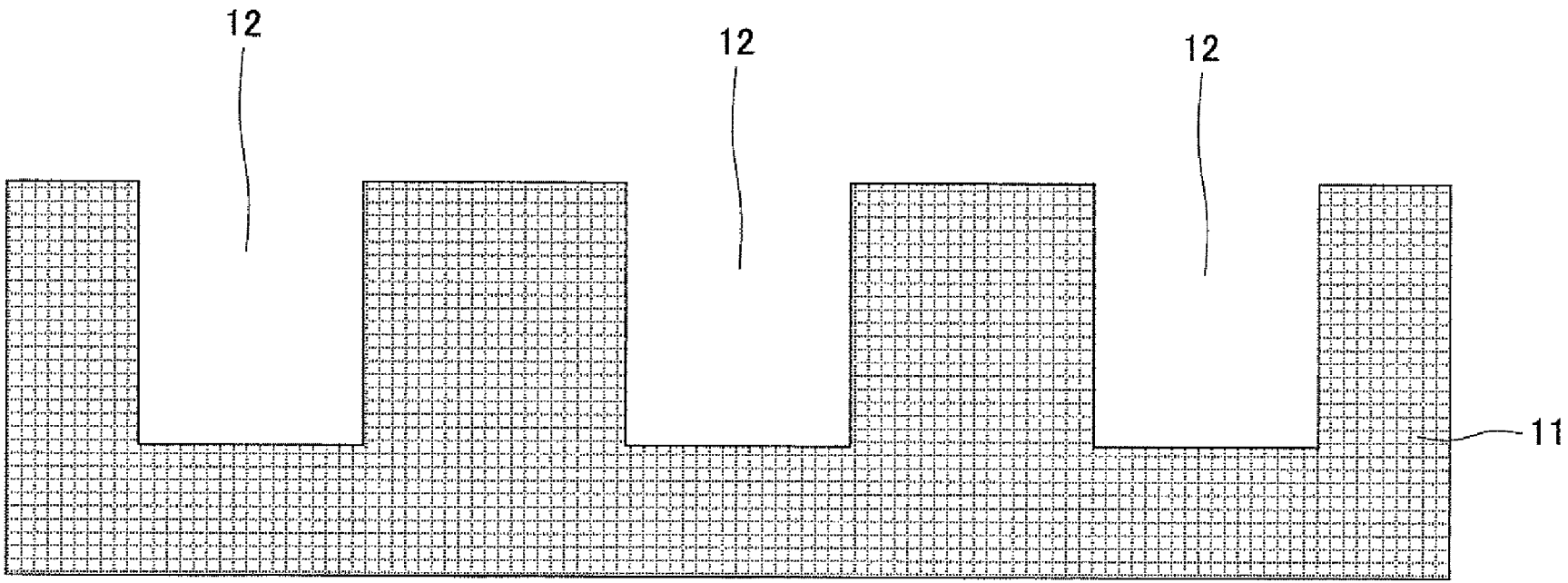
FIG. 1A illustrates a process for forming a Cu wiring pattern by a damascene technique (part 1)
Figure 1B:
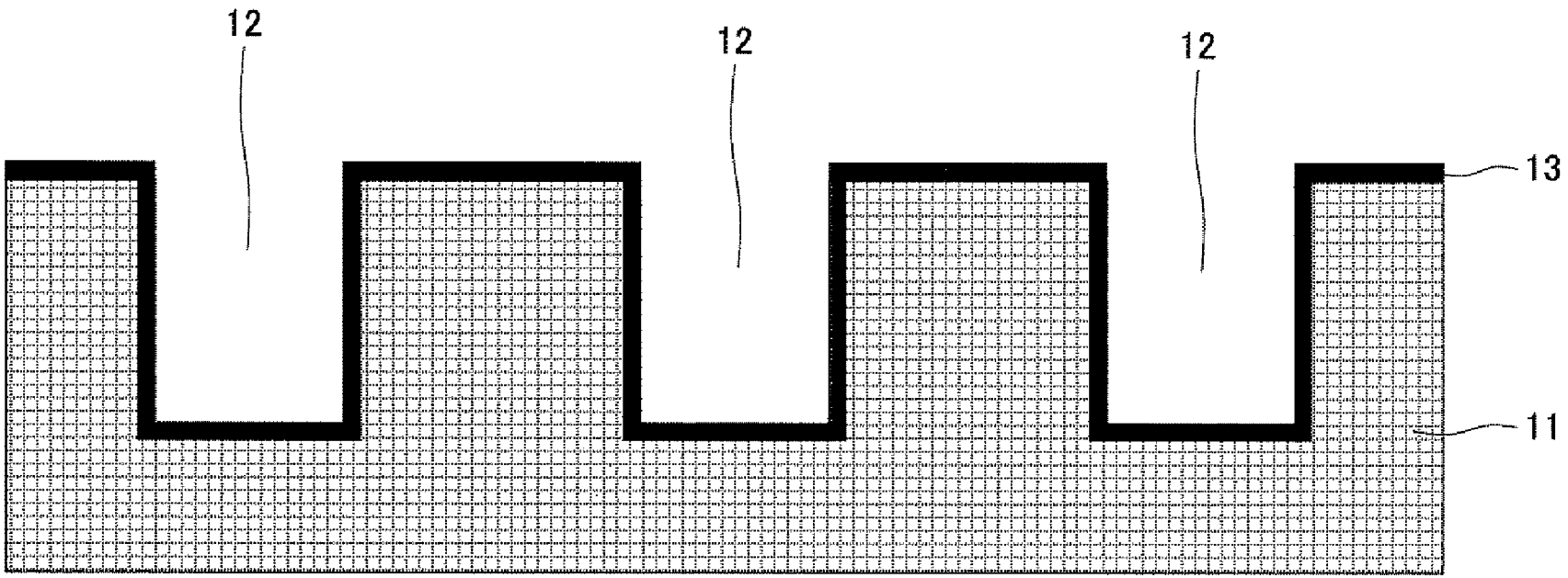
FIG. 1B illustrates the process for forming the Cu wiring pattern by the damascene technique (part 2)
Figure 1C:
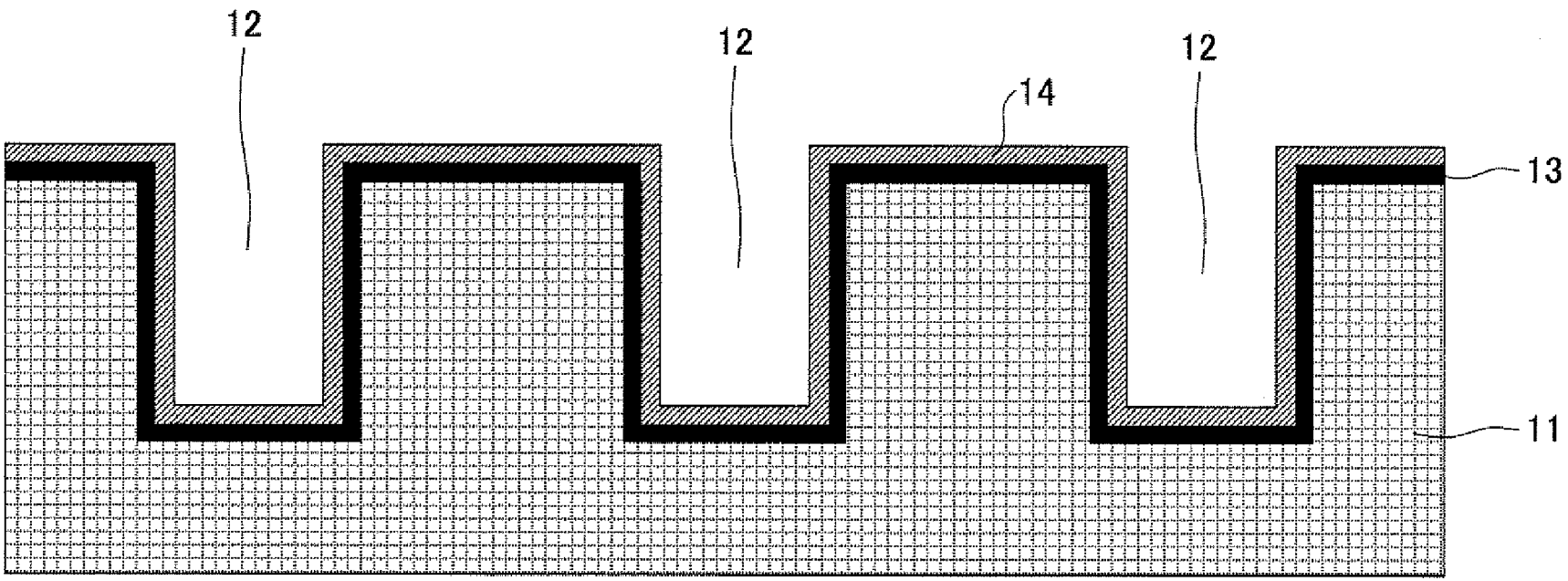
FIG. 1C illustrates the process for forming the Cu wiring pattern by the damascene technique (part 3)

With reference now to FIG. 5, in Step S11, a bias voltage of a predetermined level (several volts) is applied to the in-process substrate W in the electrolytic plating apparatus 1. This step is performed to prevent the Cu seed layer 14 (previously formed in the processes of FIGS. 1A through 1C) from dissolving into the electrolytic plating solution 2A. When immersed in the electrolytic plating solution 2A, the in-process substrate W is tilted at, for example, 3 degrees so as not to form air bubbles.

In Step S12, the in-process substrate W is then immersed in the electrolytic plating solution 2A while being rotated at a predetermined rotational speed. In Step S13, the in-process substrate W is brought back to a horizontal position. In Step S14, a plating current is supplied at a predetermined current density to the in-process substrate W while the in-process substrate W is being rotated at a predetermined speed.

FIG. 4A shows deposition of the Cu layer 15 formed over the line-and-space pattern P after the in-process substrate W is immersed in the electrolytic plating solution 2A for ten seconds. In the case of FIG. 4A, the density of the plating current supplied to the in-process substrate is 10 mA/cm$^2$ or less. During the current supply, the in-process substrate W is rotated at 90 rpm. In FIG. 4A, trenches forming the line-and-space pattern P are marked by numbers 1 through 15 from the periphery toward the center of the wafer.

With reference to FIG. 4A, over the fine line-and-space pattern P, the deposition of the Cu layer 15 starts immediately after the immersion of the in-process substrate W in the electrolytic plating solution 2A. It can be seen that, after ten seconds, overplating OvP has built up over some trenches 4, 5 and 6 by bottom-up filling.

As understood from FIG. 4A, in the initial stage of the layer plating process, the overplating OvP tends to occur within the line-and-space pattern P at a region closer to the periphery of the in-process substrate W. Due to the occurrence of the overplating OvP, the thickness of the Cu layer 15 over the remaining region becomes small, and accordingly, it is more likely to take long to obtain the bottom-up growth.

It is to be noted that a flow, as indicated by the arrow in FIG. 2, is present in the electrolytic plating solution 2A of the container 2. The in-plane unevenness of the overplating OvP in the Cu layer 15 is considered to occur due to the flow in the electrolytic plating solution 2A being superimposed on a flow induced in the electrolytic plating solution 2A by, especially, the periphery of the rotating in-process substrate W.

Once the deposition is made in a manner as illustrated in FIG. 4A, even if the Cu layer 15 is formed to have a predetermined thickness in Steps S15 and S16 where the in-process substrate W is rotated at a second rotational speed and receives application of a second current, the in-plane unevenness of the overplating OvP cannot be eliminated, as illustrated in FIG. 4B. It is sometimes the case that the thickness difference within the Cu layer 15 reaches 100 nm. If the Cu layer 15 having such massive overplating OvP is polished by CMP in the process of FIG. 1E, the dielectric film 11 is overly polished over a region with less overplating OvP or with underplating, which results in dishing. The in-plane unevenness of the overplating OvP becomes significant, particularly, in patterns formed at the periphery of the in-process substrate W, where the peripheral speed is high.

As mentioned above, in FIG. 4A, the trenches of the line-and-space pattern P are marked by numbers 1 through 15 from the periphery toward the center of the wafer. Among the trenches 1 through 15, bottom-up filling is insufficient in the trenches 1 to 3 on the periphery side and the trenches 7 to 15 on the center side.

Regarding the line-and-space pattern P in which complete bottom-up filling is achieved only for some of the trenches, as illustrated in FIG. 4A, "bottom-up symmetry" is defined as follows.

Bottom-up Symmetry=[Count of Trenches with Incomplete Bottom-up Filling on Periphery Side]/[Count of Trenches with Incomplete Bottom-up Filling on Center Side]

In the schematic example of FIG. 4A, the bottom-up symmetry is 3/9=0.33. In practice, according to FIG. 7, the bottom-up symmetry is 0.1 in the case of 90 rmp.

Figure 1D:
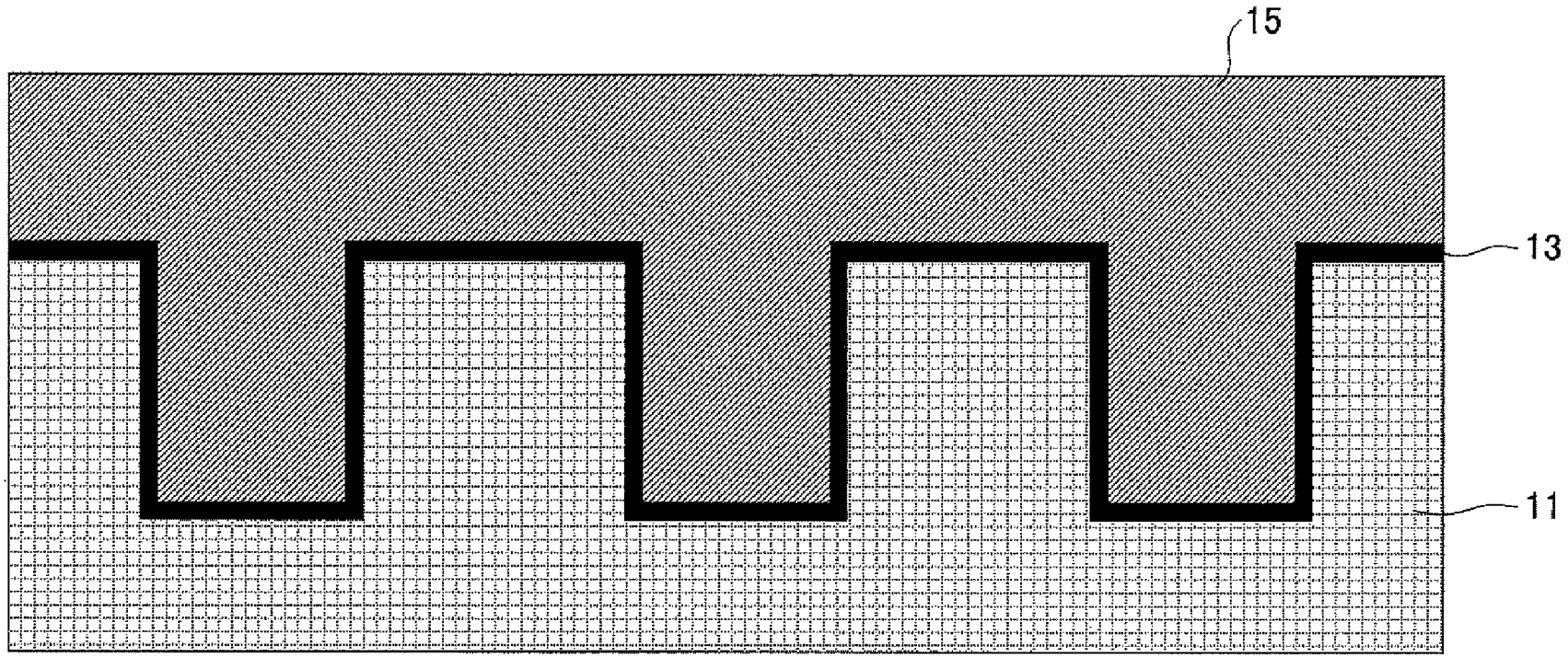
FIG. 1D illustrates the process for forming the Cu wiring pattern by the damascene technique (part 4)
Figure 1E:
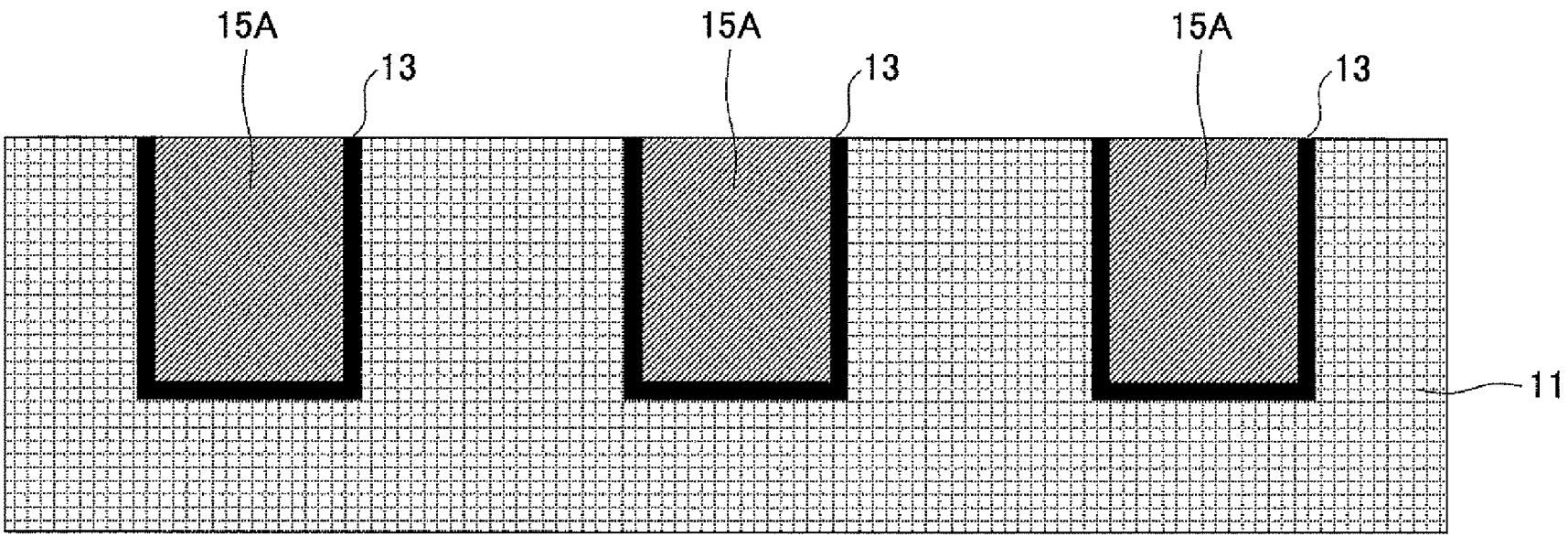
FIG. 1E illustrates the process for forming the Cu wiring pattern by the damascene technique (part 5)

In the study having provided a basis for the present disclosure, the inventors of this application have found that the in-plane unevenness of the overplating OvP in the initial stage of the plating process, as illustrated in FIG. 4A, can be eliminated by reducing the rotational speed of the in-process substrate W during the initial ten seconds of the electrolytic plating process of FIG. 1D. In addition, the inventors have also found that the in-plane unevenness in the thickness of the Cu layer 15 at the completion of the plating process is eliminated.

Figure 6A:
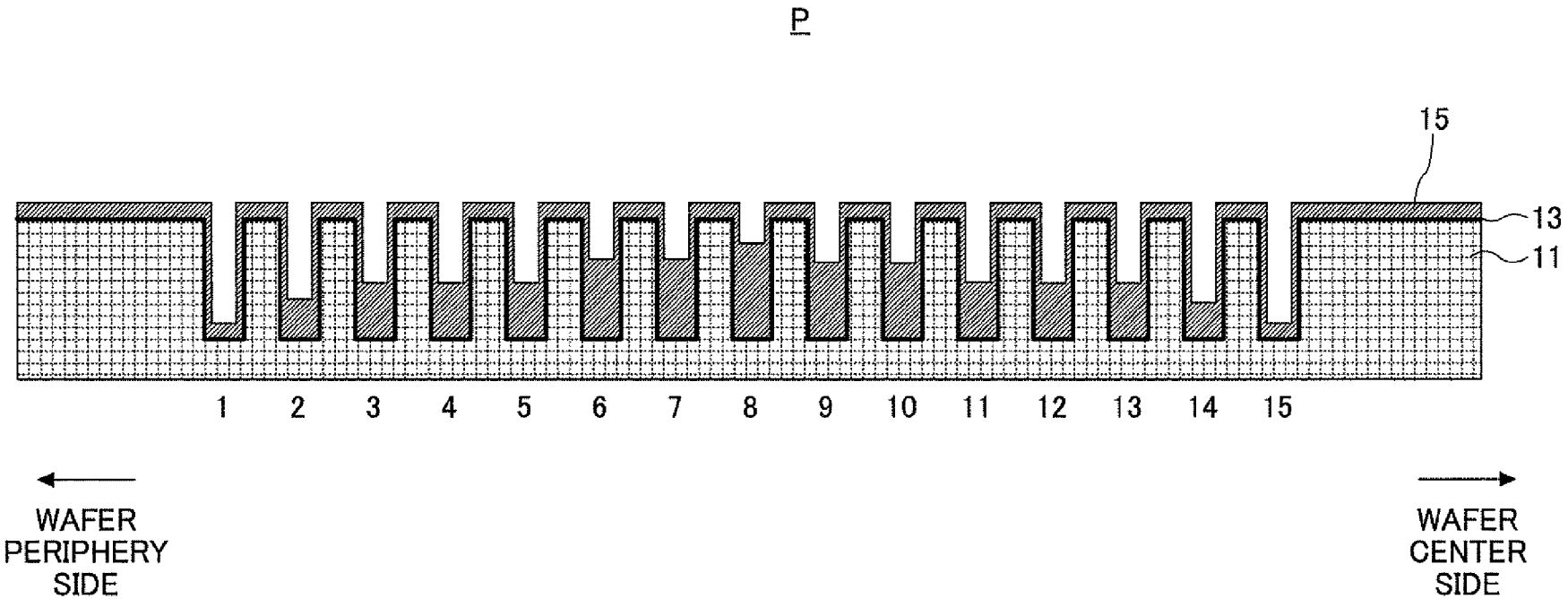
FIGS. 6A to 6B illustrate a basis of the first embodiment.
Figure 6B:
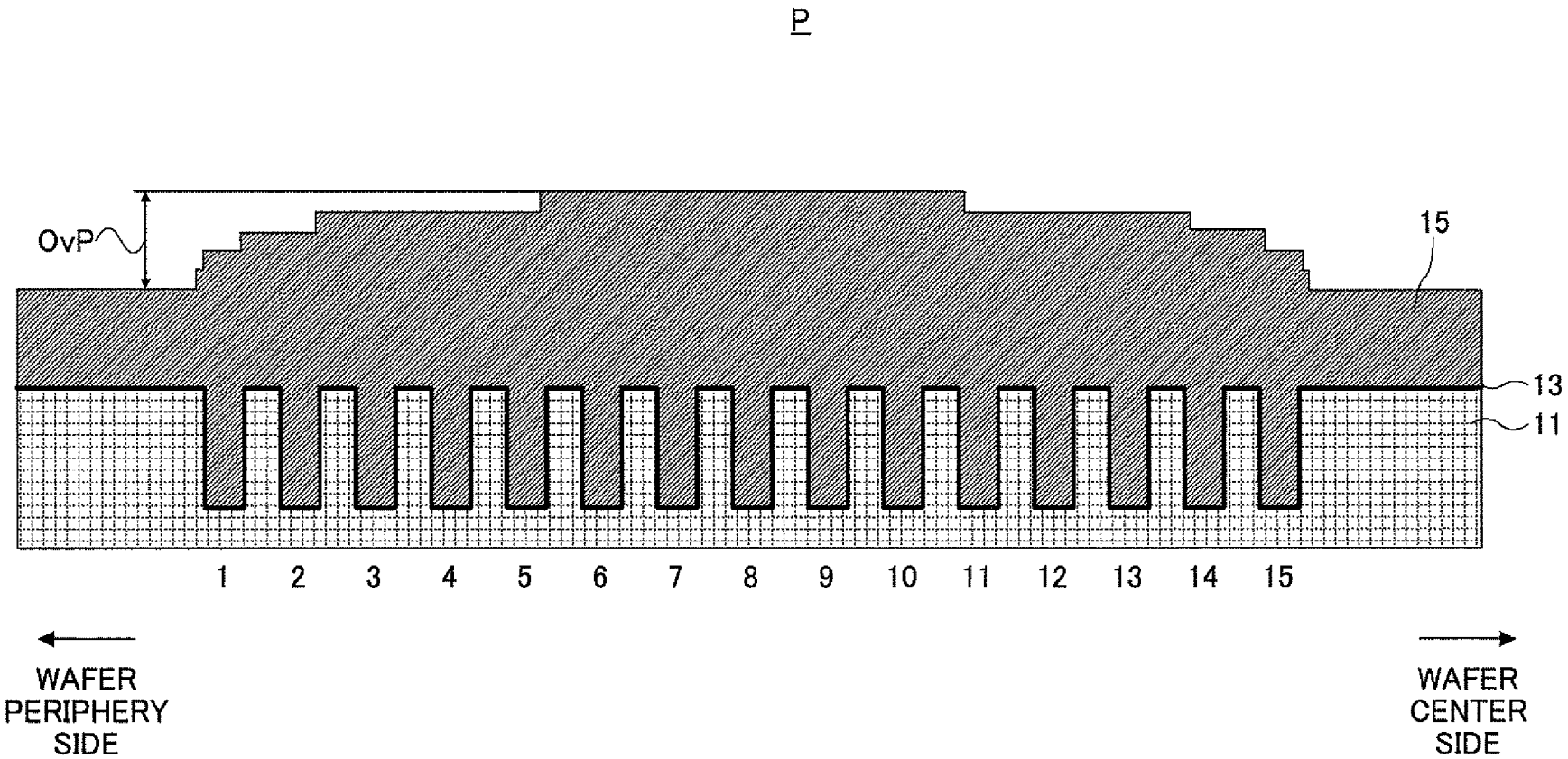

FIGS. 6A and 6B relate to the line-and-space pattern P of FIG. 3 over which the Cu layer 15 is formed according to the procedure illustrated in the flowchart of FIG. 5, and are cross sectional views along the line A-A' of FIG. 3.

In the case of FIGS. 6A and 6B, the in-process substrate W is rotated at a first rotational speed of 12 rpm in Step S14.

In the schematic example of FIG. 6A, bottom-up filling is insufficient in the trenches 1 to 7 and 9 to 15, and the bottom-up symmetry is 1.0. In practice, according to FIG. 7, the bottom-up symmetry is about 0.8 in the case of 12 rpm, which is a considerable improvement compared to the case of 90 rmp.

Figure 7:
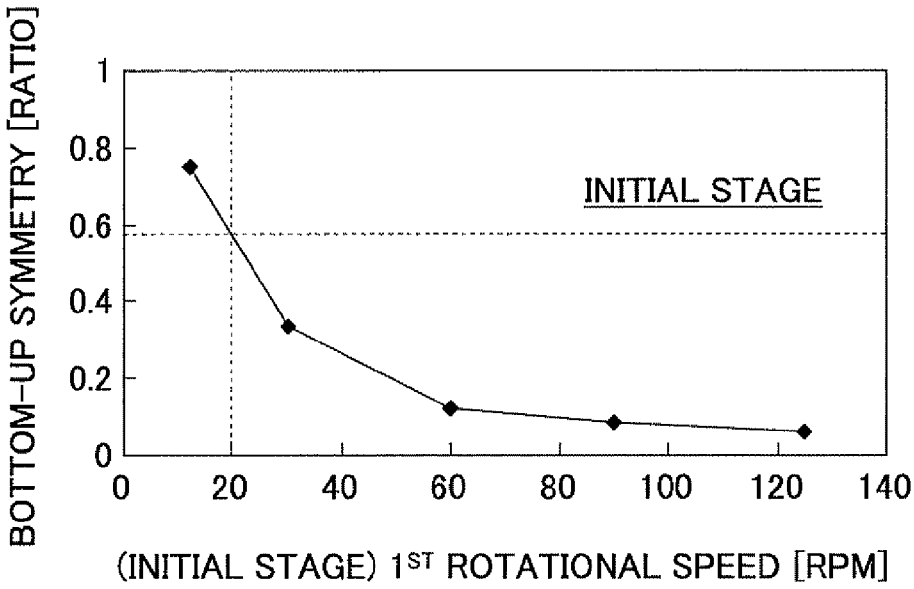
FIG. 7 illustrates a basis of the first embodiment.

FIG. 7 shows the change in the bottom-up symmetry of the Cu layer 15 in the state illustrated in FIG. 4A and FIG. 6A, i.e. prior to Steps S15 and S16, in the case where the first rotational speed (i.e. the rotational speed of the in-process substrate W in Step S14) is changed in the range between 12 rpm and 125 rpm.

It can be seen from FIG. 7 that the bottom-up symmetry is about 0.1 if the first rotational speed is 60 rpm or more, i.e. if the peripheral speed of the in-process substrate W made of silicon wafer and having a diameter of 300 mm is $18000\times\pi$ mm/min or more ($D\times N\times\pi \geqq 18000\times\pi$ mm/min; D: wafer diameter; N: rotational speed; and $\pi$: constant term). This indicates that, within the line-and-space pattern P close to the wafer periphery, excessive overplating OvP occurs at a region largely shifted from the middle portion in the radial direction, as illustrated in FIG. 4A.

On the other hand, if the first rotational speed is less than 60 rpm ($D\times N\times\pi < 18000\times\pi$ mm/min), the bottom-up symmetry improves dramatically. In particular, if the first rotational speed is 20 rpm or less ($D\times N\times\pi < 6000\times\pi$ mm/min), the bottom-up symmetry is as high as about 0.6 or more.

Accordingly, the present embodiment sets the rotational speed of the in-process substrate W in Step S14 to 20 rpm or less ($D\times N\times\pi \leqq 6000\times\pi$ mm/min), more preferably to 10 rpm or less ($D\times N\times\pi \leqq 3000\times\pi$ mm/min), and performs the initial stage of the plating process for ten seconds after immersion of the in-process substrate W into the electrolytic plating solution 2A. Herewith, it is possible to allow the Cu layer 15 in the initial stage of the plating process to have a bottom-up symmetry of close to 1.0, as in the case depicted in FIG. 6A. This results in better uniformity in the thickness of the Cu layer 15 over the line-and-space pattern P as well as over the wafer plane in the initial stage of the plating process (corresponding to FIG. 6A). Then, over such a Cu layer 15 formed in the initial stage, a subsequent stage of the plating process is carried out, and herewith, the Cu layer 15 at the completion of the plating process has better thickness uniformity over the line-and-space pattern P as well as over the wafer plane, as illustrated in FIG. 6B.

Figure 8:
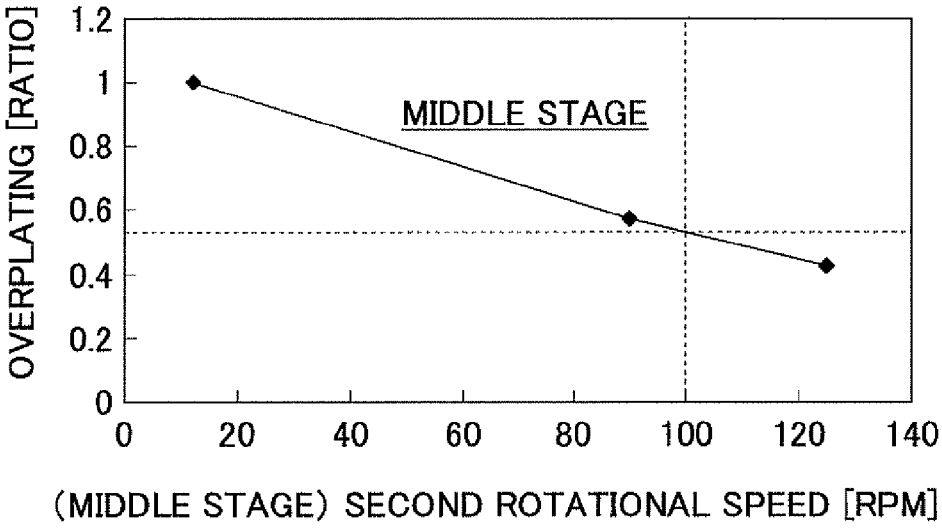
FIG. 8 illustrates a basis of the first embodiment.

FIG. 8 shows the change in the overplating OvP of the Cu layer 15 in the state illustrated in FIG. 6B, in the case where a second rotational speed in Step S16 is changed. Note that each value of the overplating OvP is normalized by the overplating OvP obtained when the second rotational speed is 12 rpm, and is thus expressed in ratio form.

It can be seen from FIG. 8 that the overplating OvP of the Cu layer 15 at the completion of the plating process (corresponding to FIG. 6B) decreases if the rotational speed of the in-process substrate W in Step S16 increases. This leads to a favorable effect such that the amount of polishing the Cu layer 15 in the subsequent CMP process is reduced. In particular, if the second rotational speed is five times or more the first rotational speed, i.e. 100 rpm or more ($D\times N\times\pi \geqq 30000\times\pi$ mm/min), the amount of the overplating OvP at the completion of the plating process of the Cu layer 15 can be reduced to 50% or less compared to the case where the second rotational speed is 12 rpm.

Thus, since the Cu layer 15 is formed first in Step S14 using the low first rotational speed, even if the second rotational speed of the in-process substrate W in Steps S15 and S16 is increased, the Cu layer 15 at the completion of the plating process is able to have better thickness uniformity over the line-and-space pattern P as well as over the wafer plane.

Figure 9:
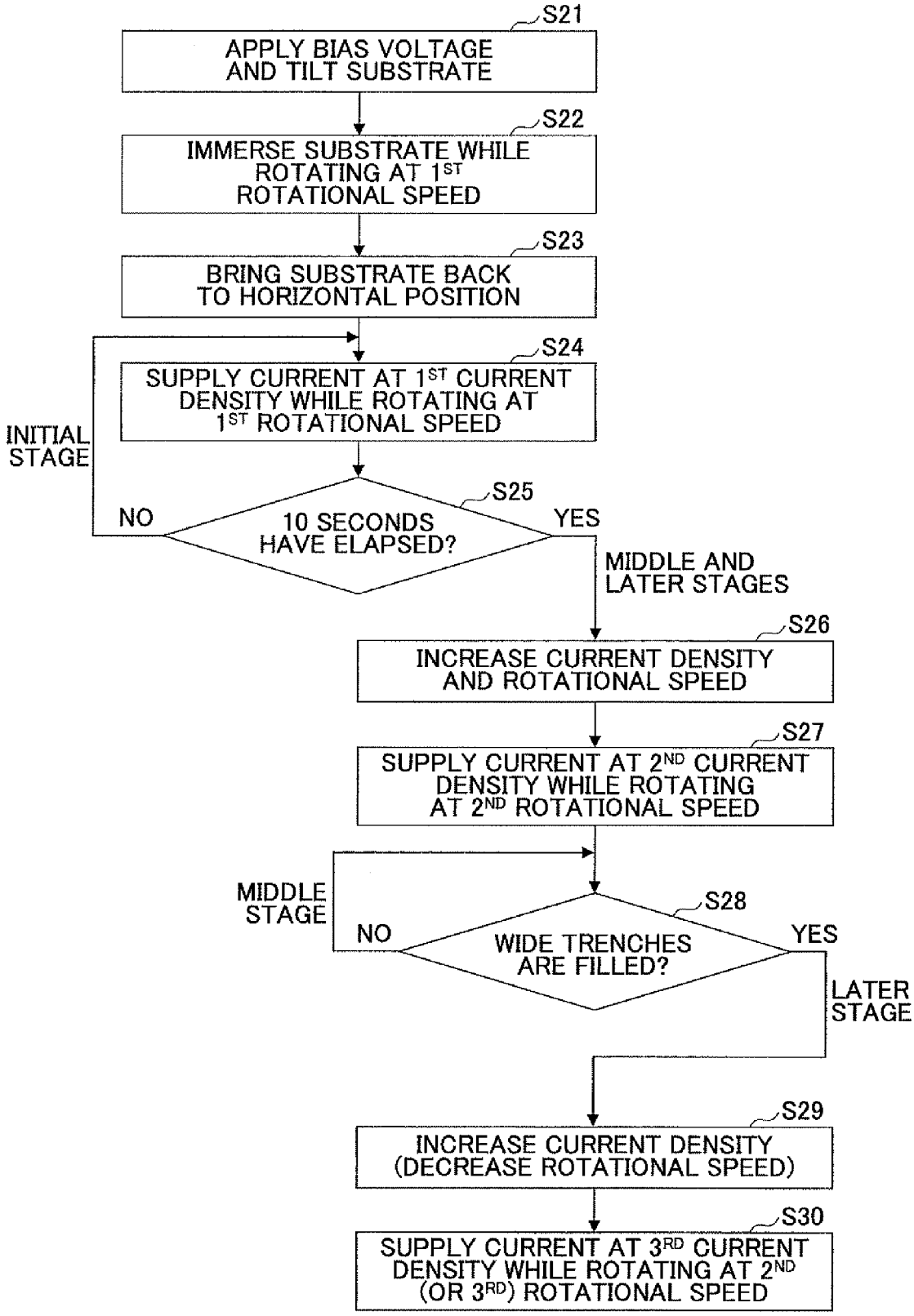
FIG. 9 is a flowchart showing a method for electrolytic plating according to the first embodiment.
Figure 11:
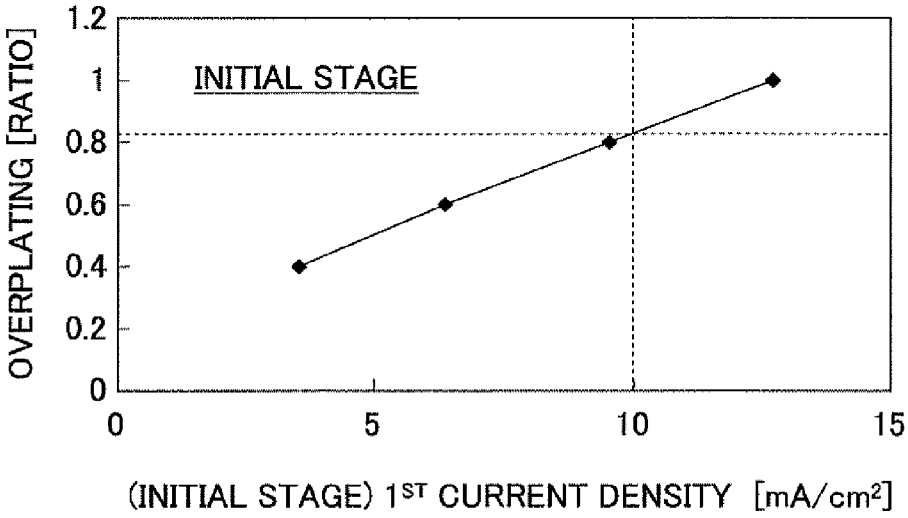
FIG. 11 illustrates a basis of the first embodiment.
Figure 12:
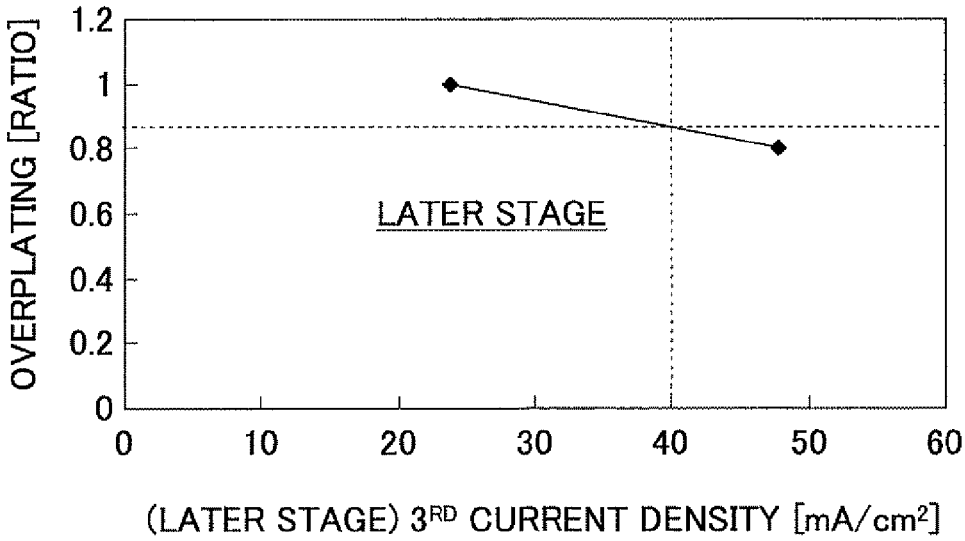
FIG. 12 illustrates a basis of the first embodiment.

Based on the findings illustrated in FIGS. 7 and 8, the inventors of the present application further carried out an experiment illustrated in FIG. 9, which corresponds to the first embodiment of the present disclosure, to study the effect of the current densities used in the stages of the plating process of the Cu layer 15. The results are illustrated in FIGS. 11 and 12.

With reference now to FIG. 9, in Step S21, a bias voltage of several volts is applied to the in-process substrate W, as in Step S11, and then the in-process substrate W is tilted at, for example, 3 degrees. In this condition, in Step S22, the in-process substrate W is immersed in the electrolytic plating solution 2A while being rotated at a predetermined rotational speed. In Step S23, the in-process substrate W is brought back to a horizontal position. In Steps S24 and S25 (corresponding to the initial stage of the plating process, as illustrated in FIG. 6A) while the in-process substrate W is rotated at a first rotational speed of 20 rpm or less, a plating current is supplied to the in-process substrate W at a first current density in the range of 3 mA/cm$^2$ to 13 mA/cm$^2$ for ten seconds.

When, in Step S25, it is determined that the first ten seconds have elapsed, the rotational speed of the in-process substrate W is increased to a second rotational speed of 100 rpm or more in Step S26. Also in Step S26, the density of the plating current supplied to the in-process substrate W in the electrolytic plating solution 2A is increased from the first current density to a second current density of 15 mA/cm$^2$. In Step S27, the plating process of the Cu layer 15 is continuously carried out under the same conditions stated above (the middle stage).

Figure 10A:
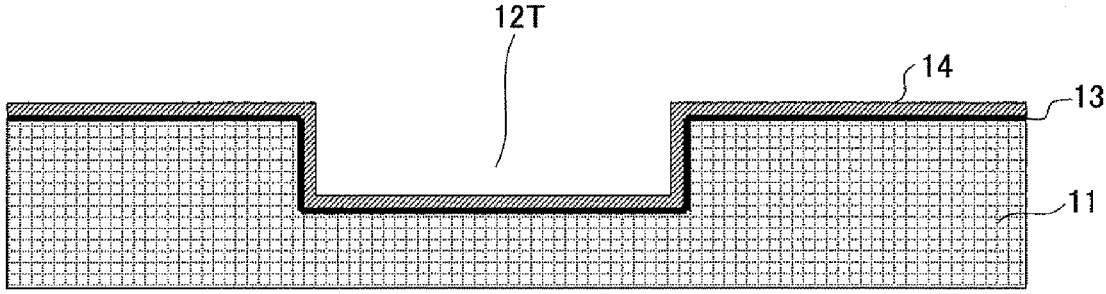
FIGS. 10A to 10C illustrate a middle stage of the electrolytic plating.
Figure 10B:
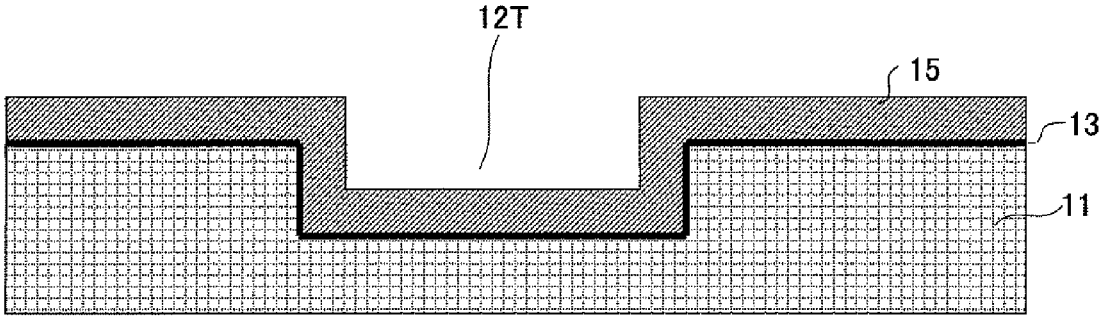
Figure 10C:
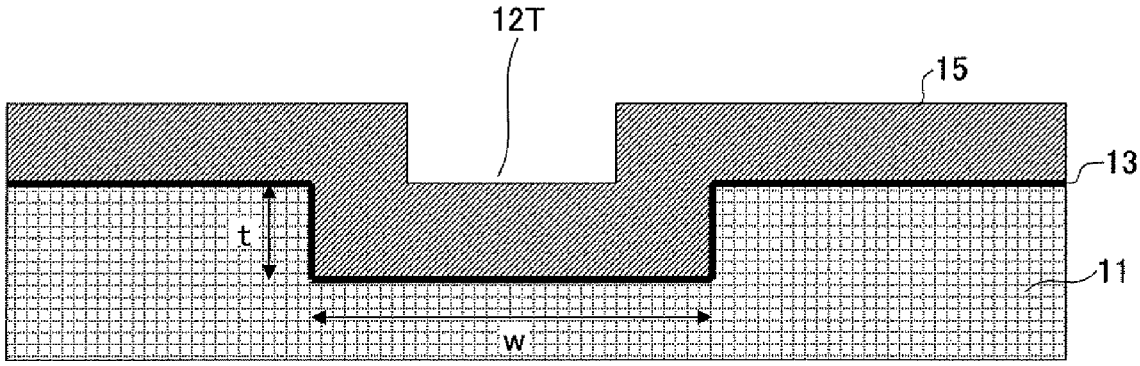

In Step S28, the Cu layer 15 fills wide trenches in a conformal manner, as illustrated in FIGS. 10A through 10C. Note that the process of FIG. 10A corresponds to that of FIG. 1C, and the barrier metal film 13 and the Cu seed layer 14 are formed in a manner to cover a wide trench 12T having a width W and a depth t in the dielectric film 11. In this condition, if the electrolytic plating process (corresponding to FIG. 1D) is performed, the Cu layer 15 is formed conformal to the cross section of the wide trench 12T. By continuing the electrolytic plating process, the trench 12T is completely filled with the Cu layer 15, as depicted in FIG. 10C. Such conformal formation of the Cu layer 15 occurs in trenches whose width W is about twice or more the depth t. Then, the plating process of the Cu layer 15 moves to the later stage. In Step S29, the density of the plating current is increased to a third current density in the range of 24 mA/cm$^2$ to 48 mA/cm$^2$. In Step S30, the plating current is supplied at the third current density to the in-process substrate W while the in-process substrate W is being rotated at the second rotational speed.

FIG. 11 shows the change in the overplating ratio of the Cu layer 15 at the completion of the plating process obtained in Step S30 in the case where the second current density is 15 mA/cm$^2$ and the first current density is changed in the range of 3 mA/cm$^2$ to 13 mA/cm$^2$. Note that each value of the overplating OvP is normalized by the overplating OvP obtained when the first current density is 13 mA/cm$^2$, and is thus expressed in ratio form.

It can be seen from FIG. 11 that the overplating OvP of the Cu layer 15 at the completion of the plating process largely decreases if the first current density is low. Therefore, it can be said that a reduction in the first current density is effective to decrease the overplating OvP. According to FIG. 11, for example, the overplating ratio can be controlled to 0.8 or less by setting the first current density to 10 mA/cm$^2$ or less.

FIG. 12 shows the change in the overplating ratio of the Cu layer 15 at the completion of the plating process obtained in Step S30 in the case where the first current density is 3 mA/cm$^2$ and the third current density is changed in the range between 24 mA/cm$^2$ and 48 mA/cm$^2$. Note that each value of the overplating OvP is normalized by the overplating OvP obtained when the third current density is 24 mA/cm$^2$, and is thus expressed in ratio form.

As can be seen from FIG. 12, the overplating OvP can be reduced by increasing the third current density in Steps S29 and S30. For example, the overplating ratio can be reduced to about 0.85 by setting the third current density to 40 mA/cm$^2$ or more.

Note that the duration of the initial stage of the plating process of the Cu layer 15 in Step 24 does not necessarily have to be ten seconds, and may be a shorter period of time. In the case where it is difficult to make an assessment for the condition of FIG. 10C, additional steps may be added to the later stage where the plating current is supplied at the third current density.

In view of the experiment illustrated in the flowchart of FIG. 9, in the present embodiment, the electrolytic plating process of FIG. 1D is arranged such that, at the beginning, the in-process substrate W is rotated at a first rotational speed of 20 rpm or less ($D \times N \times \pi \leqq 6000 \times \pi$ mm/min), preferably 10 rpm or less ($D \times N \times \pi \leqq 3000 \times \pi$ mm/min), while the plating current is supplied at a current density of 10 mA/cm$^2$ or less. This condition is maintained for ten seconds or less after the immersion of the in-process substrate W into the electrolytic plating solution 2A (the initial stage). According to the arrangement of the present embodiment, the bottom-up symmetry of the Cu layer 15 in the initial stage of the plating process is improved, which results in better thickness uniformity of the Cu layer 15 over the line-and-space pattern P as well as over the wafer plane.

After the initial stage of the plating process, the rotational speed is increased to a second rotational speed of 100 rpm or more ($D \times N \times \pi \geqq 30000 \times \pi$ mm/min), which is five times or more the first rotational speed, and at the same time, the current density is increased to 20 mA/cm$^2$ or less. Then, this condition is maintained until the Cu layer 15 fills the wide trenches 12T in a conformal manner (the middle stage). Herewith, it is possible to prevent a large increase in the amount of the overplating OvP while maintaining thickness uniformity of the Cu layer 15 over the line-and-space pattern P as well as over the wafer plane.

Furthermore, after the middle stage of the plating process, the plating current is supplied at a higher third current density to the in-process substrate W (the later stage), whereby it is possible to further prevent a large increase in the amount of the overplating OvP.

Figure 13A:
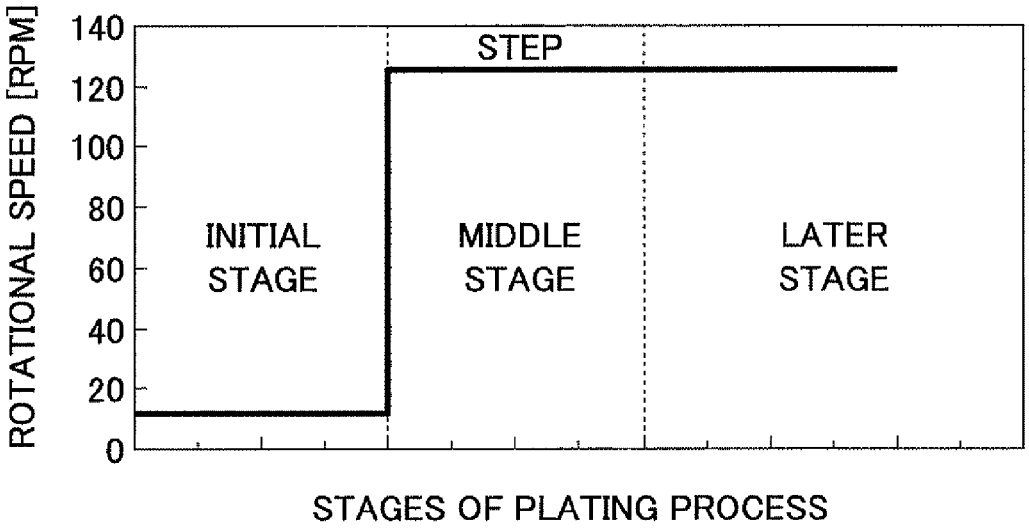
FIG. 13A shows change in rotational speed of an in-process substrate according to the first embodiment.
Figure 13B:
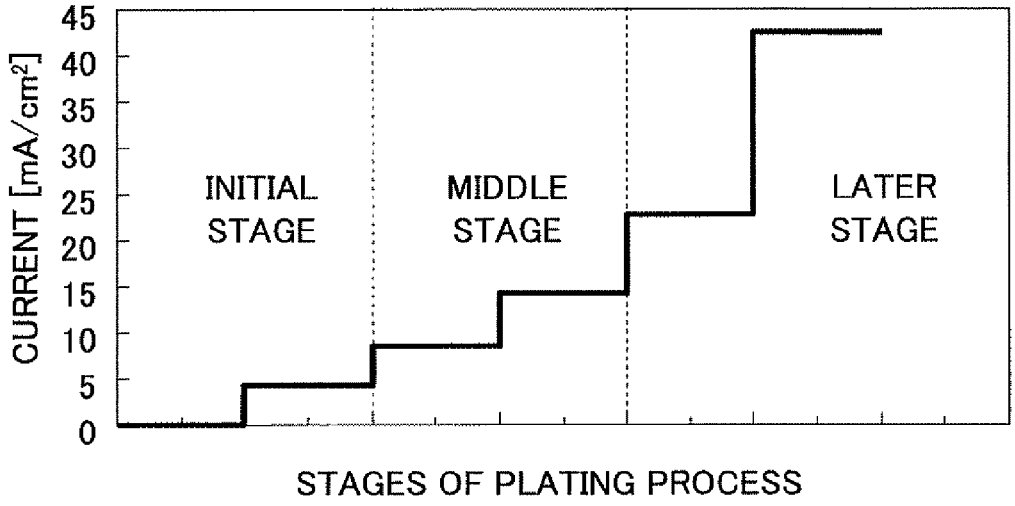
FIG. 13B shows change in a plating current according to the first embodiment.

FIG. 13A shows an example of the change in the rotational speed of the in-process substrate W in the initial, middle and later stages of the plating process (refer to the flowchart of FIG. 9). On the other hand, FIG. 13B shows an example of the change in the current density applied to the in-process substrate W in the initial, middle and later stages of the layer formation.

With reference to FIG. 13A, the rotational speed is increased in a step-wise fashion when the plating process shifts from the initial stage to the middle stage, and is then maintained constant. On the other hand, the current density is gradually increased in the middle stage, and is then largely increased in the later stage.

Figure 14A:
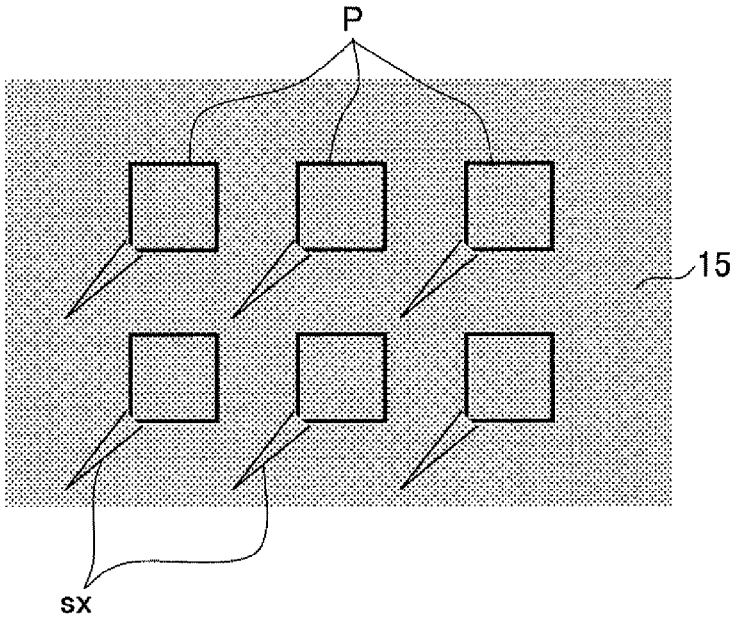
FIG. 14A shows an example of streaks.

The inventors of the present application have found that, in the case of controlling the rotational speed of the in-process substrate W in accordance with FIG. 13A, linear streaks sometimes occur in the Cu layer 15, as illustrated in FIG. 14A, at positions corresponding to edges of the line-and-space pattern P disposed under the Cu layer 15. It has been learned that such streaks tend to occur if trenches of the line-and-space pattern P are deep.

Figure 14B:
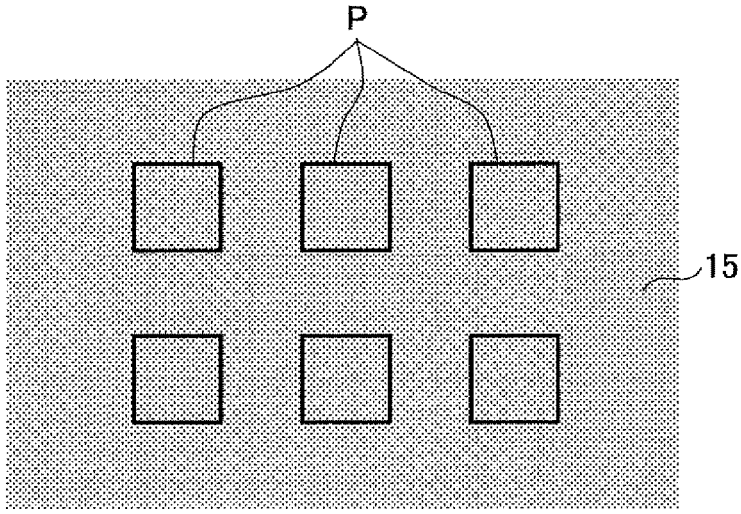
FIG. 14B shows streak control.
Figure 15A:
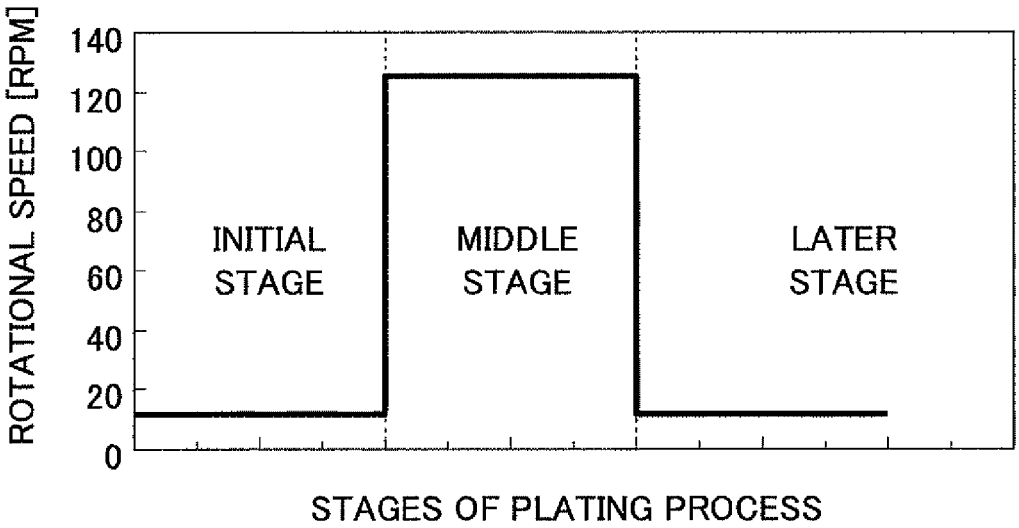
FIG. 15A shows a modification of the first embodiment.

Such streaks can be prevented, as illustrated in FIG. 14B, by decreasing the rotational speed of the in-process substrate W in the later stage of the plating process of the Cu layer 15 to, for example, the same level as the rotation speed in the initial stage in a manner as illustrated in FIG. 15A.

Figure 15B:
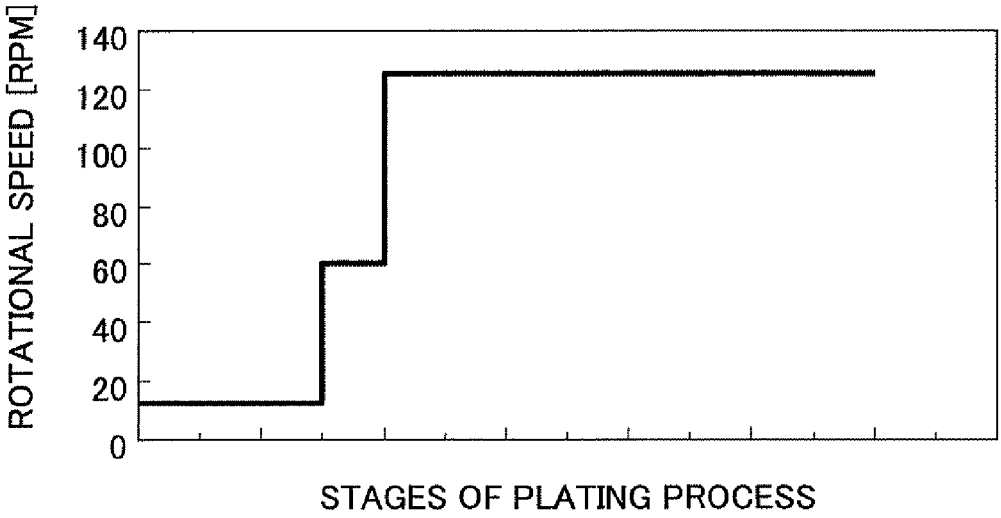
FIG. 15B shows another modification of the first embodiment.
Figure 15C:
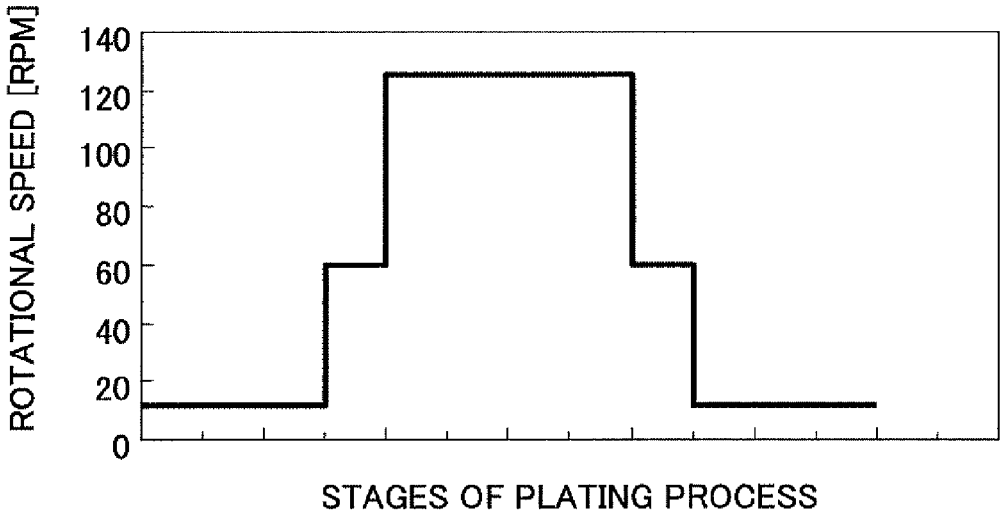
FIG. 15C shows another modification of the first embodiment.

Note that the rotational speed over the initial, middle and later stages may be changed in a piecemeal fashion, for example, as illustrated in FIG. 15B or FIG. 15C.

FIGS. 16A through 16G illustrate a method for forming a Cu wiring pattern of the first embodiment of the present disclosure, which has been designed based on the above-described findings.

Figure 16A:
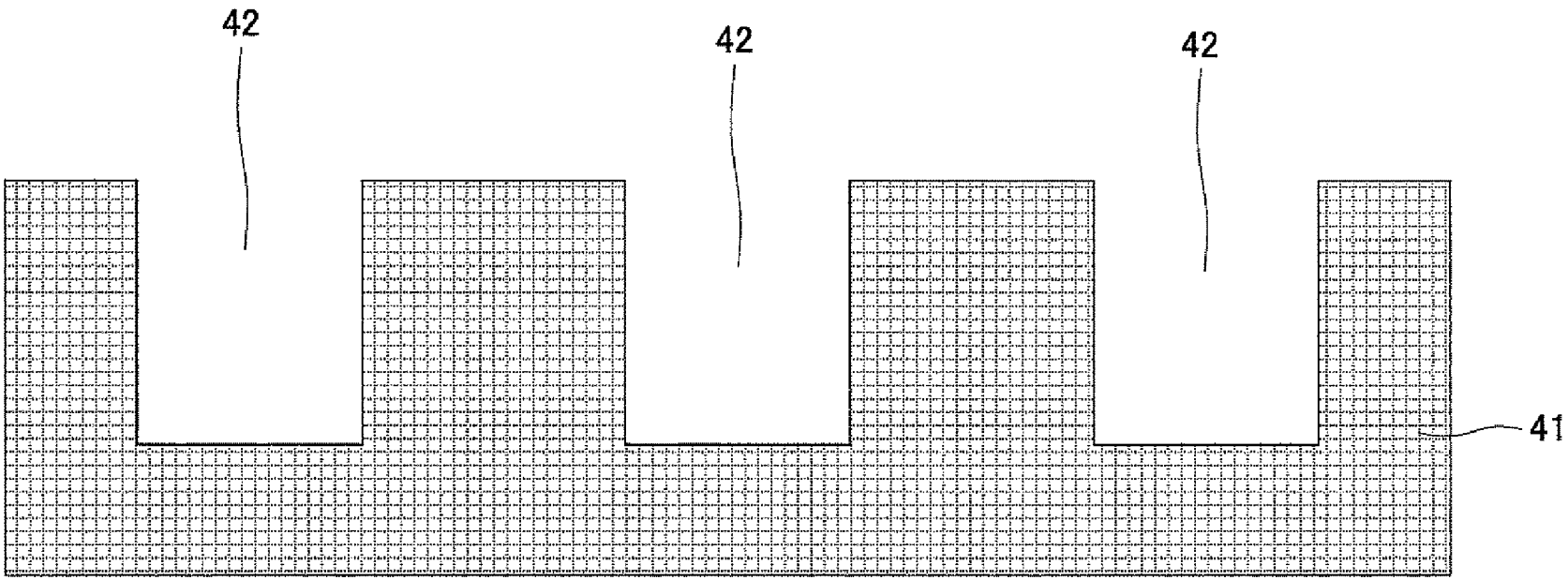
FIGS. 16A to 16G illustrate a process for forming a Cu wiring pattern by a damascene technique according to the first embodiment.
Figure 16B:
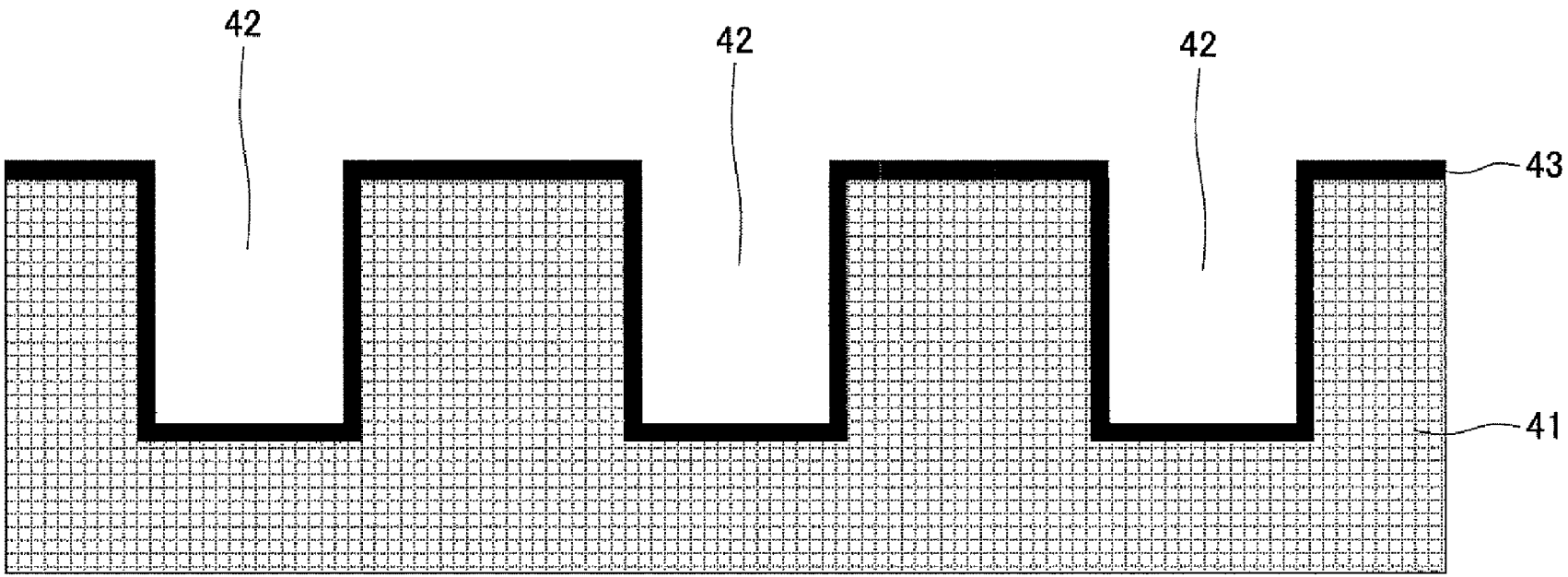

With reference now to FIG. 16A, depressions 42 serving as wiring trenches or vias are formed in a dielectric film 41. Next, as illustrated in FIG. 16B, a Ta barrier metal film 43 is formed on the bottom and sidewalls of each depression 42, as well as on the top-field surface of the dielectric film 41, in a manner so as to follow the shape of the depressions 42. The barrier metal film 43 is, for example, 5 nm to 20 nm in thickness. According to FIG. 16C, a Cu seed layer 44 is deposited on the barrier metal film 43 by PVD in a manner so as to follow the shapes of the depressions 42. The Cu seed layer 44 is, for example, 40 nm to 100 nm.

Figure 16C:
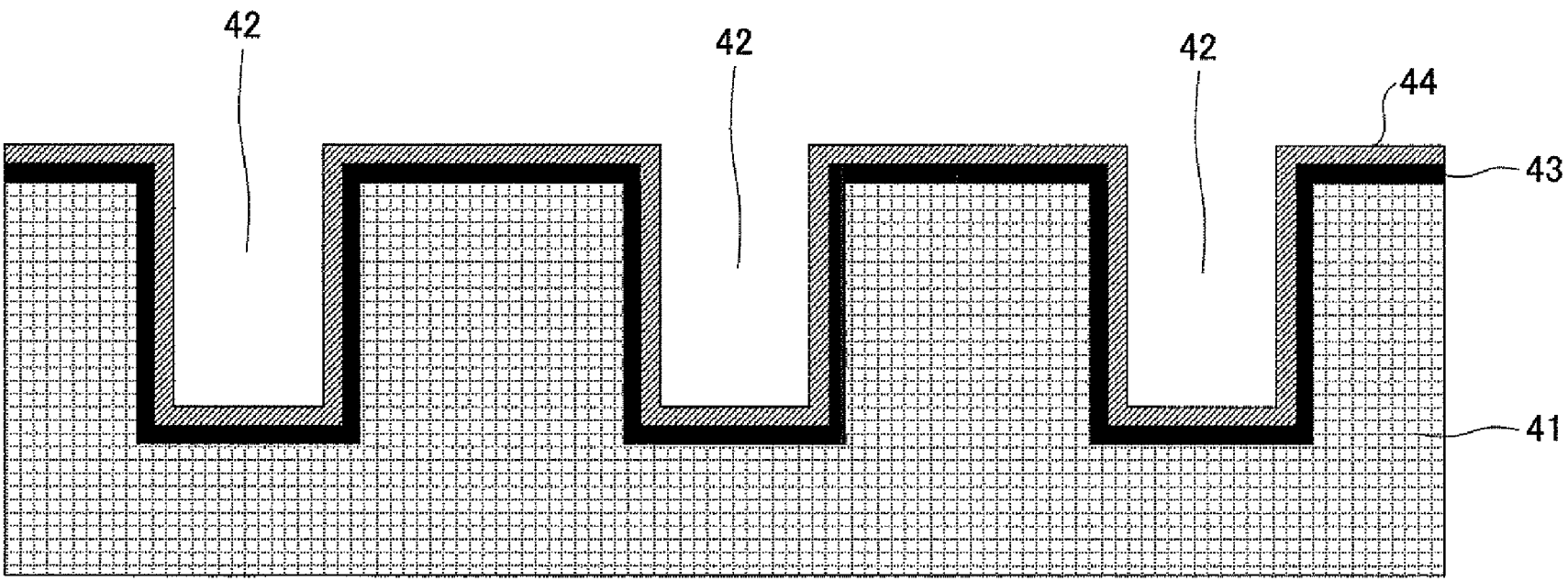
Figure 16D:
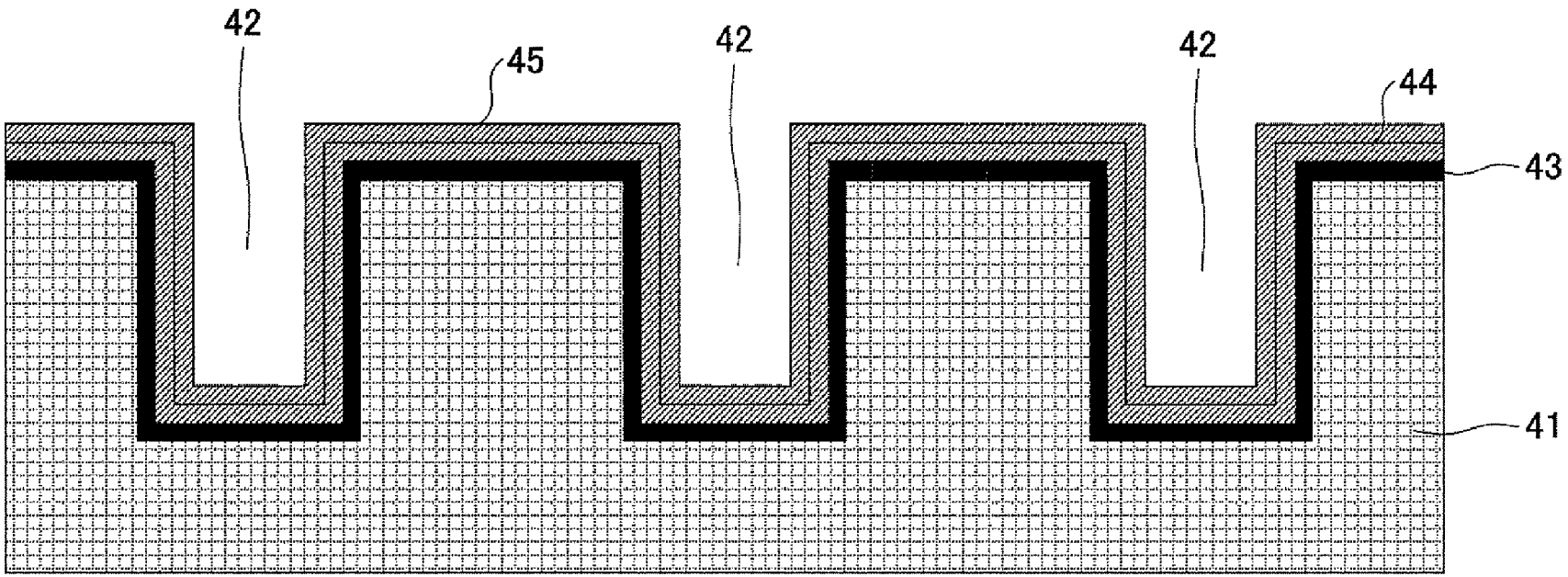

As illustrated in FIG. 16D, electrolytic plating with the Cu seed layer 44 serving as an electrode is performed in the electrolytic plating apparatus 1, and the depressions 42 are bottom-up filled by depositing a Cu layer 45 over the surface of the Cu seed layer 44. The electrolytic plating solution 2A used is made by adding SPS serving as an accelerator and polyethylene glycol serving as a suppressor to a cupric sulfate aqueous solution, as described above.

In the process of FIG. 16D, the in-process substrate W, which is a silicon wafer having the structure depicted in FIG. 16C, is immersed in the electrolytic plating solution 2A of the electrolytic plating apparatus 1. In the initial stage of the plating process, the in-process substrate W is rotated at a rotational speed of 20 rpm or less ($D \times N \times \pi \leqq 6000 \times \pi$ mm/min), preferably 10 rpm or less ($D \times N \times \pi \leqq 3000 \times \pi$ mm/min), for ten seconds after the immersion. Herewith, in the process of FIG. 15D, the Cu layer 45 formed in the initial stage has a bottom-up symmetry of close to 1.0, thus exhibiting excellent thickness uniformity over the line-and-space pattern P as well as over the wafer plane. Also, the amount of overplating of the Cu layer 45 at the completion of the plating process can be reduced if the density of the plating current in the initial stage is 10 $mA/cm^2$ or less.

Figure 16E:
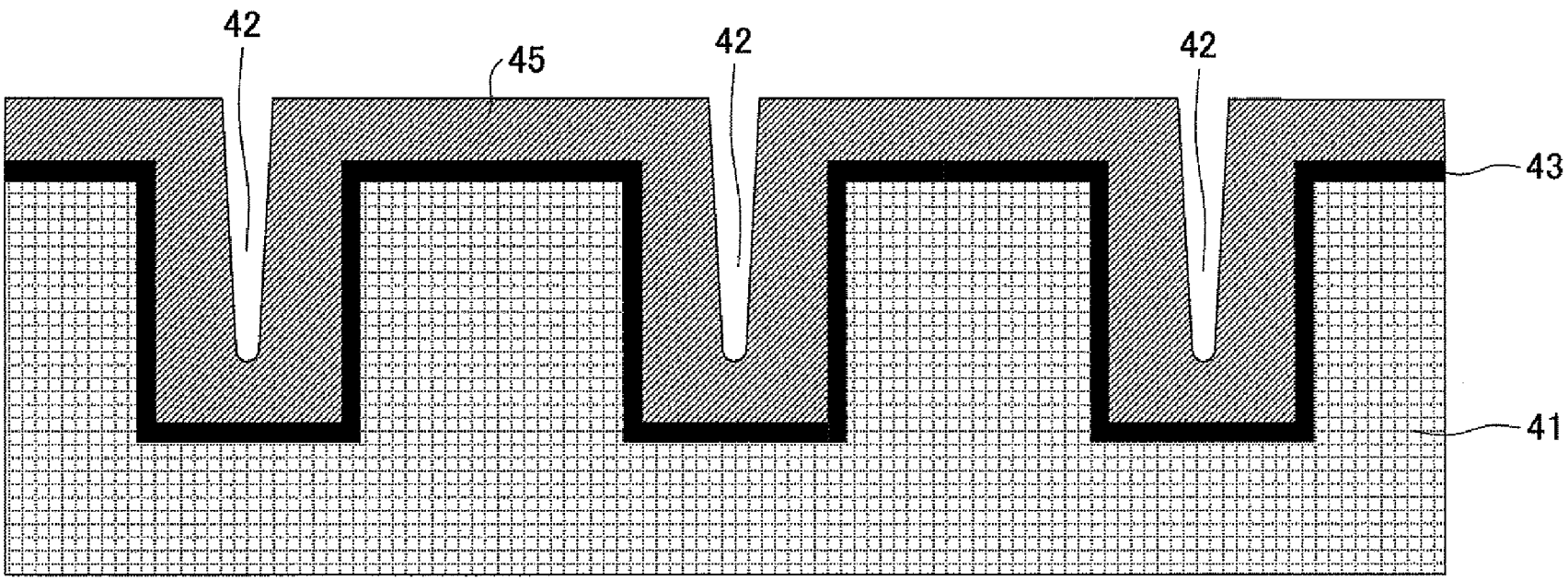

In the middle stage of the plating process depicted in FIG. 16E, the rotational speed is changed in accordance with the profile shown in FIG. 13A, 15A, 15B or 15C while the density of the plating current is increased from the first current density to 20 $mA/cm^2$ or less.

Figure 16F:
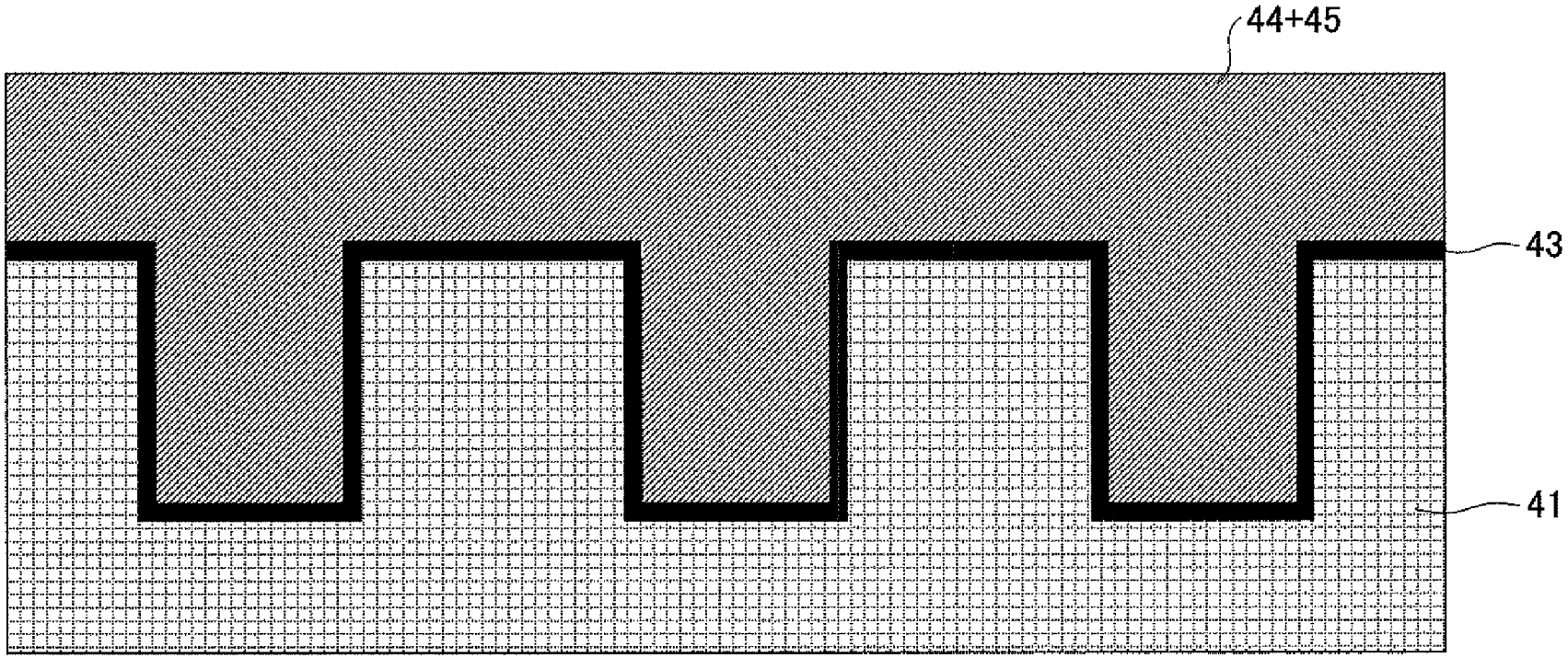

In the process of FIG. 16F, the current density of the plating current is further increased, which enables a reduction in the amount of the overplating of the Cu layer 45, as described in FIG. 11. In the later stage of the plating process depicted in FIG. 16F, the rotational speed of the in-process substrate W is reduced if needed to eliminate the occurrence of streaks described in FIG. 14A above.

Figure 16G:
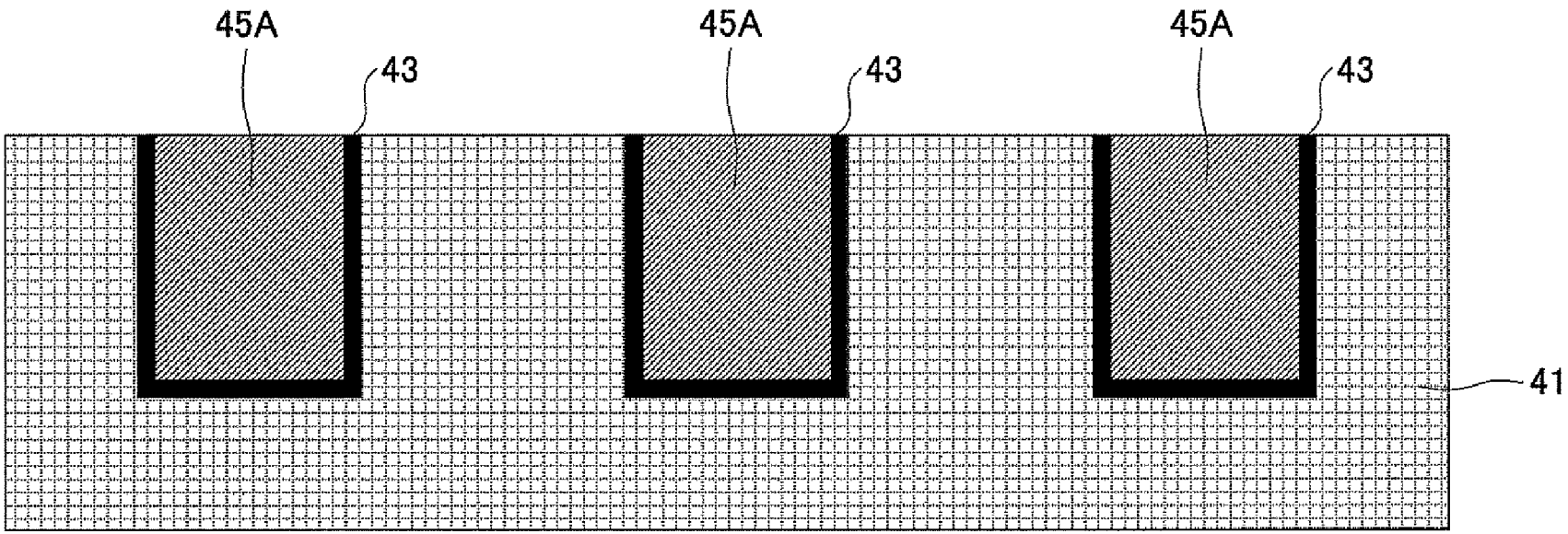

In the process of FIG. 16G, an unnecessary part of the Cu layer 45 on the surface of the interlayer dielectric film 41 is removed by CMP, and thereby a Cu wiring pattern 45A having less dishing can be obtained. As a result, variation in the wiring height and resistance within the formed Cu wiring layer attributable to dishing is reduced, which in turn leads to a reduction in variation in the characteristics of semiconductor devices to be formed.

(b) Second Embodiment

Next is described a process for manufacturing a multilayer wiring structure according to the second embodiment of the present disclosure with reference to FIGS. 17A through 17L.

Figure 17A:
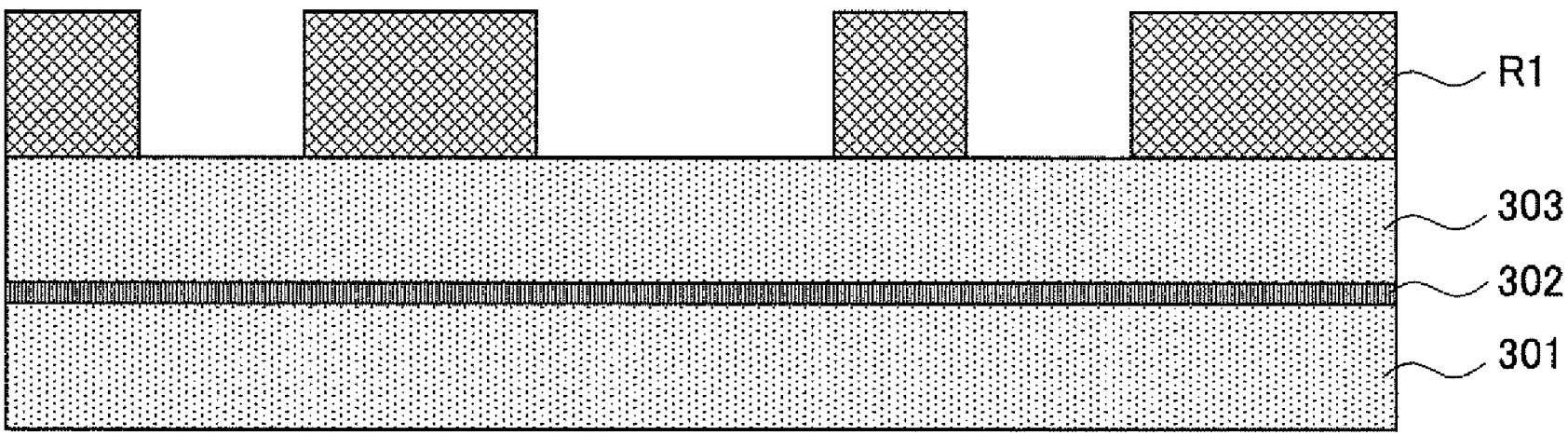
FIGS. 17A to 17L illustrate a process for forming a Cu wiring pattern by a dual damascene technique according to the second embodiment.

With reference to FIG. 17A, over a dielectric film 301 on a silicon substrate (not shown), an interlayer dielectric film 303 made of, for example, $SiO_2$ is formed with an SiN film 302 interposed between them. A resist pattern R1 corresponding to a desired wiring pattern is formed on the interlayer dielectric film 303.

Figure 17B:
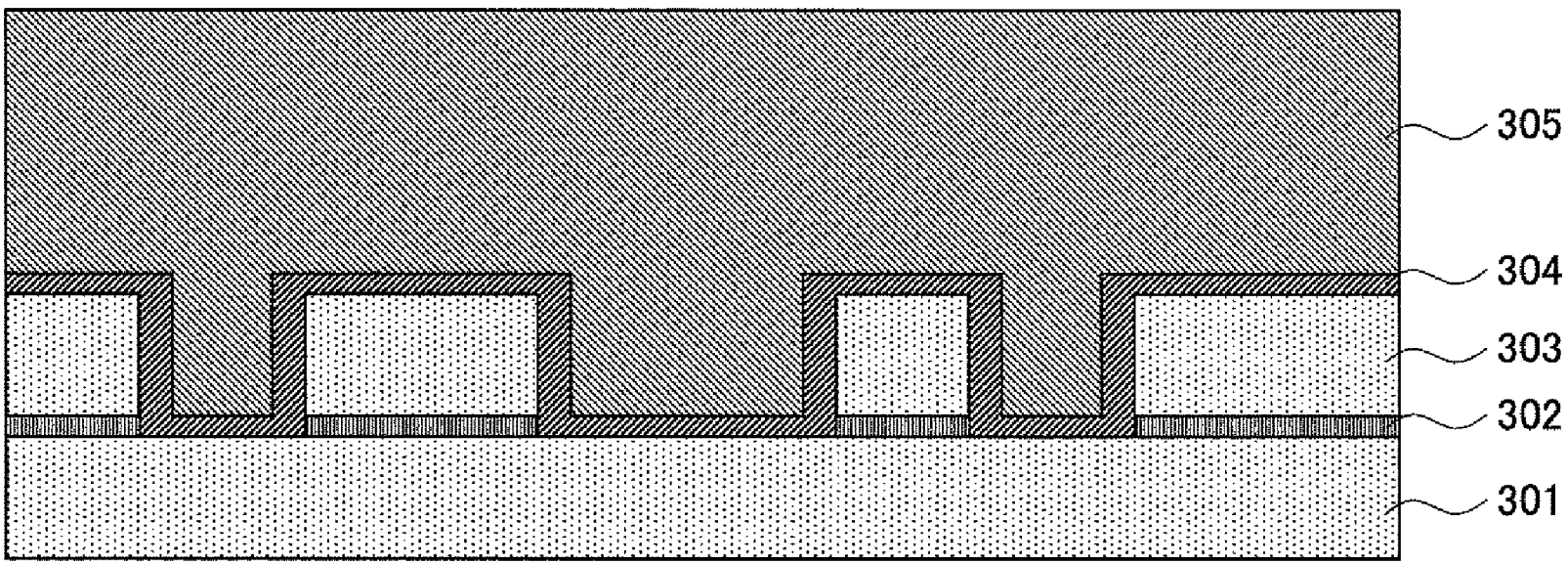

Next, in the process of FIG. 17B, a pattern is developed in the interlayer dielectric film 303 using the resist pattern R1 as a mask. As a result, wiring trenches corresponding to a desired wiring pattern is formed in the interlayer dielectric film 303. Then, the patterned interlayer dielectric film 303 is covered by a Ta barrier metal film 304. Subsequently, the processes of FIGS. 16A through 16G are performed, whereby a Cu layer 305 is formed by electrolytic plating so as to fill in the wiring trenches.

Figure 17C:
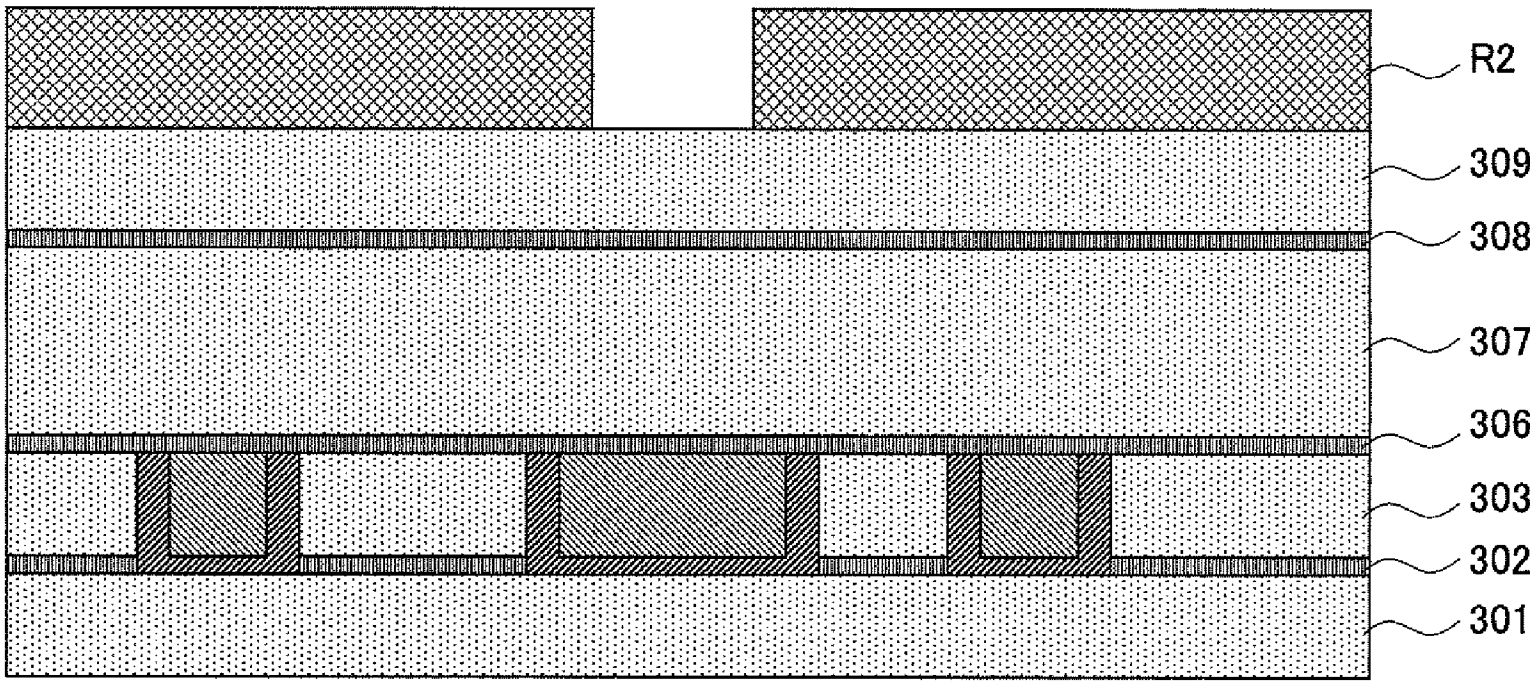

In the process of FIG. 17C, the Cu layer 305 and the barrier metal film 304 disposed below the Cu layer 305 are polished and removed by CMP until the surface of the interlayer dielectric film 303 is exposed. Then, over the structure formed in this manner, another interlayer dielectric film 307 made of, for example, $SiO_2$ is formed with an SiN barrier film 306 interposed between them.

Further in the process of FIG. 17C, over the interlayer dielectric film 307, another interlayer dielectric film 309 made of, for example, $SiO_2$ is formed with an SiN barrier film 308 interposed between them. Then, a resist pattern R2 corresponding to desired contact holes is formed over the interlayer dielectric film 309.

Figure 17D:
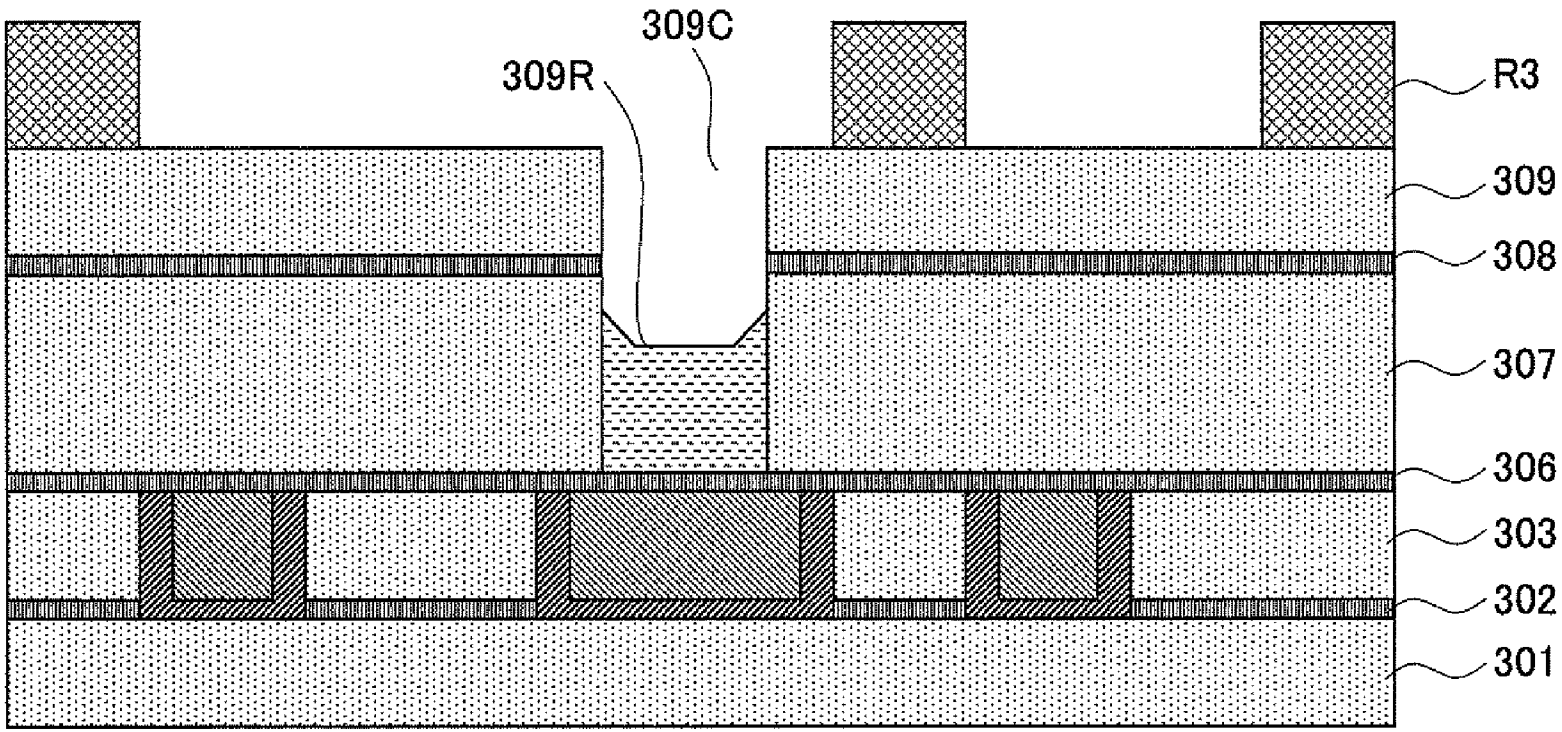

Next, in the process of FIG. 17D, a pattern is developed sequentially in the interlayer dielectric film 309, the barrier film 308 and the interlayer dielectric film 307 using the resist pattern R2 as a mask until the SiN barrier film 306 is exposed. In this manner, contact holes 309C are formed. Subsequently, a nonphotosensitive resin film is applied to fill in the contact holes 309C. Then, the resin film over the interlayer dielectric film 309 is dissolved and removed to thereby leave a resin protection portion 309R.

Further in the process of FIG. 17D, a resist pattern R3 corresponding to wiring trenches desired to be formed in the interlayer dielectric film 309 is formed over the interlayer dielectric film 309.

Figure 17E:
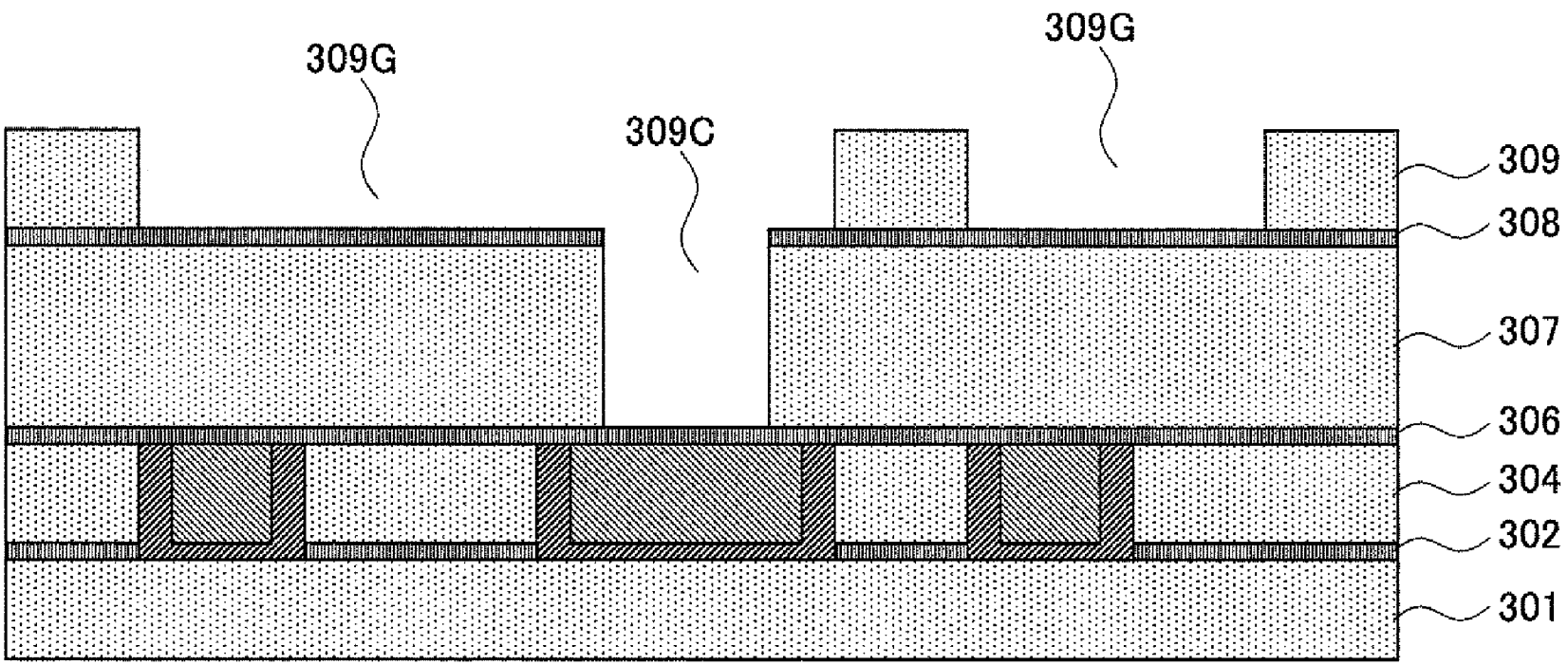

In the process of FIG. 17E, while the inner wall surface of each contact hole 309C is protected by the resin protection portion 309R, a pattern is developed in the interlayer dielectric film 309 using the resist pattern R3 as a mask until the SiN barrier film 308 is exposed. Herewith, desired wiring trenches 309G are formed in the interlayer dielectric film 308.

Furthermore in the process of FIG. 17E, the resin protection portion 309R is removed by an ashing process.

Figure 17F:
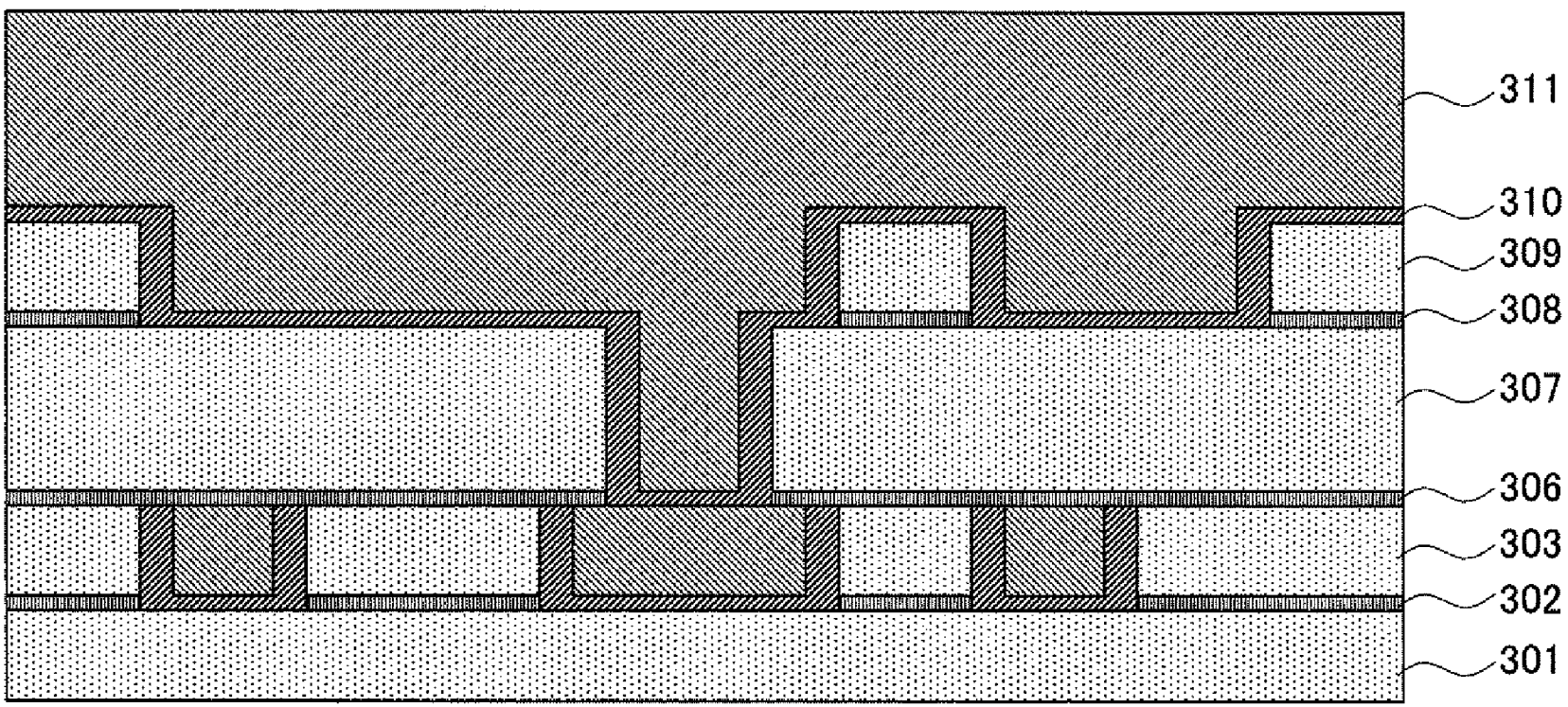

In the process of FIG. 17F, using the interlayer dielectric film 309 as a self-aligned mask, the SiN barrier films 308 and 306 are removed from the bottom of the wiring trenches 309G and the contact holes 309C. Then, the surface of the structure obtained in this manner is covered by a Ta barrier metal film 310. Subsequently, the process of FIGS. 16A through 16G are performed, whereby a Cu layer 310 is formed to fill in the contact holes 309C and wiring trenches 309G.

Next, in the process of FIG. 17G, the Cu layer 311 and the barrier metal film 310 disposed below the Cu layer 311 are removed by CMP until the surface of the interlayer dielectric film 309 is exposed. Then, over the structure formed in this manner, an SiN barrier film 312 and an interlayer dielectric film 313 made of, for example, $SiO_2$ are further formed.

Figure 17G:
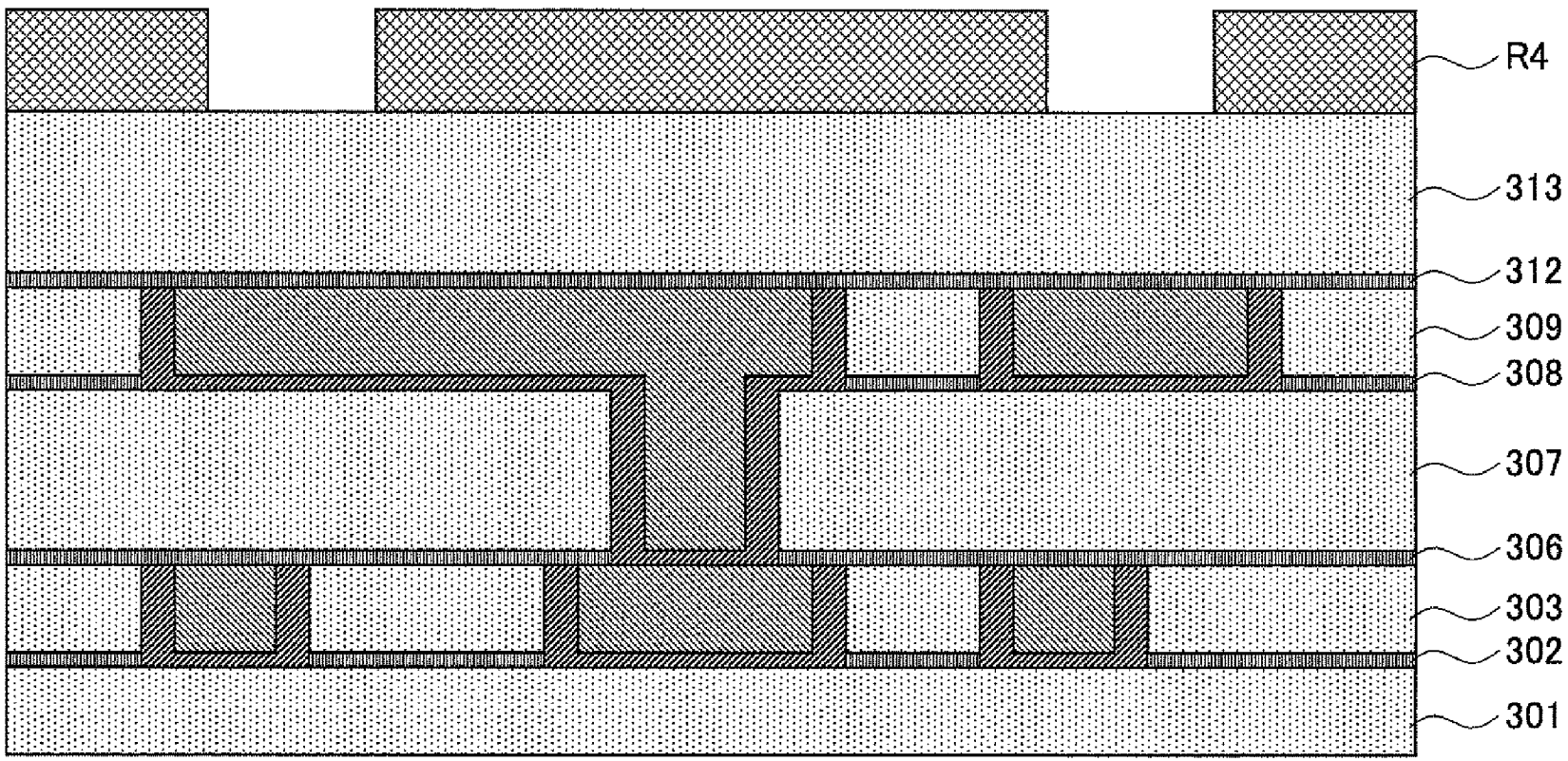

Further in the process of FIG. 17G, a resist pattern R4 corresponding to contact vias desired to be formed in the interlayer dielectric film 313 is formed over the interlayer dielectric film 313.

Figure 17H:
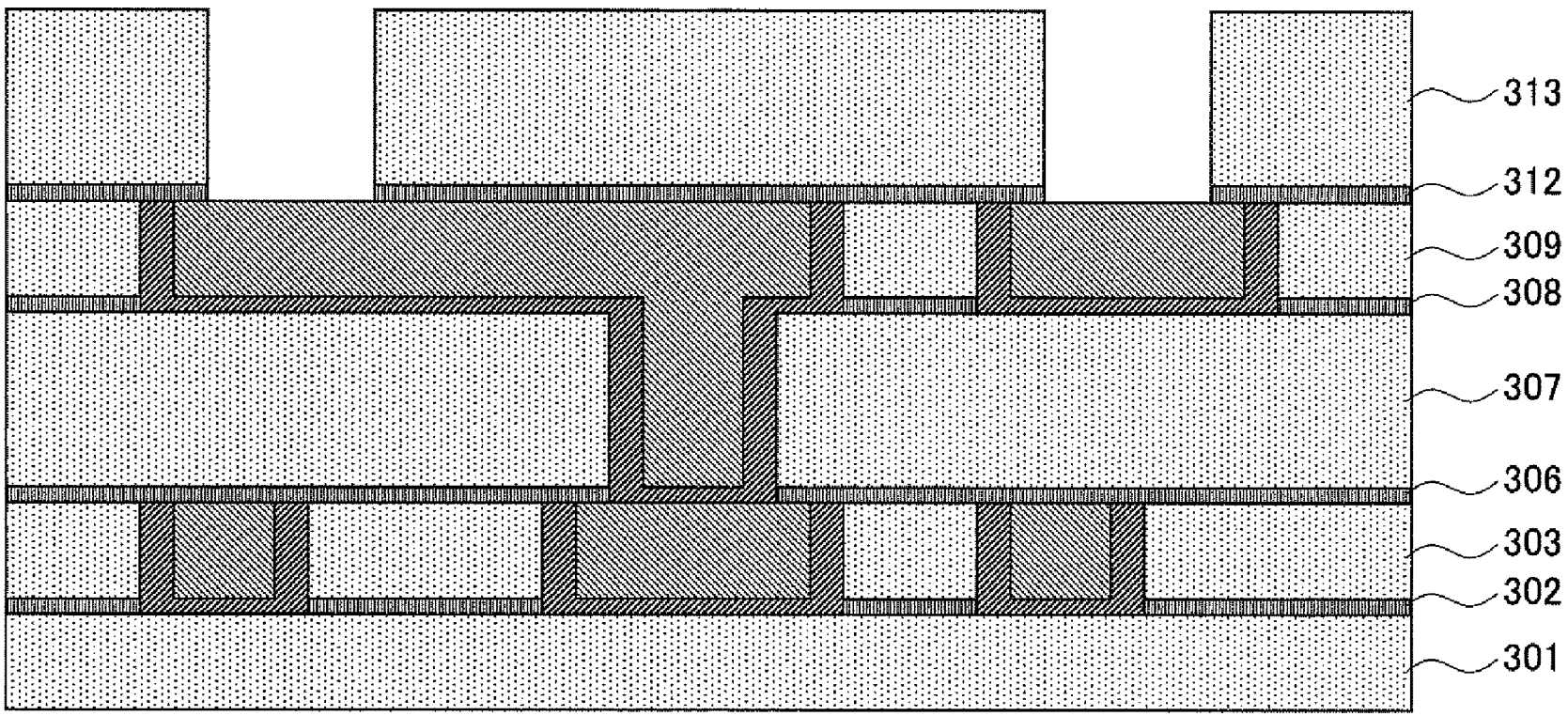

In the process of FIG. 17H, a pattern is developed in the interlayer dielectric film 313 and the SiN barrier film 312 using the resist pattern 4 as a mask. As a result, desired vias 313V are formed in the interlayer dielectric film 313.

Figure 17I:
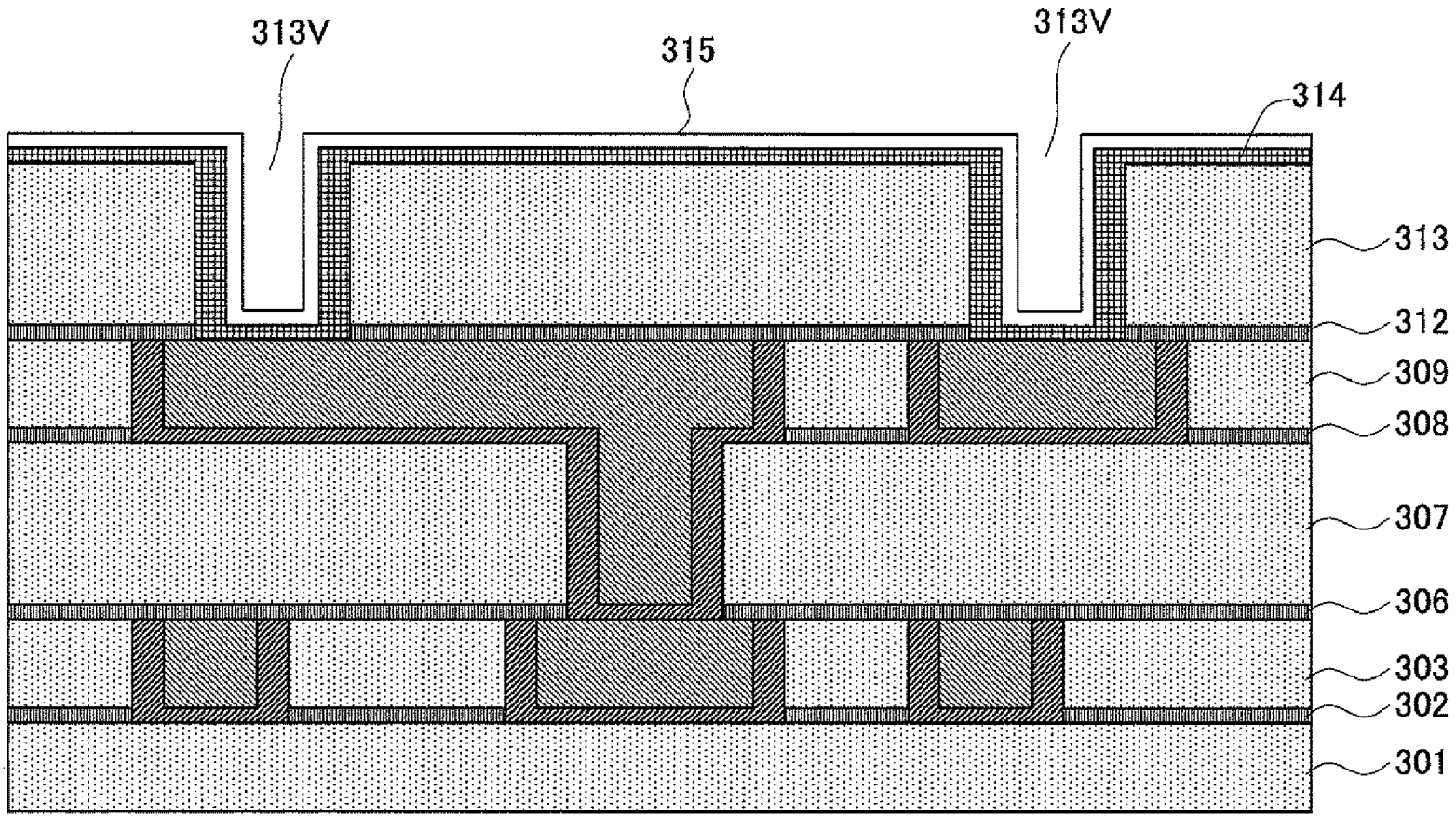
Figure 17J:
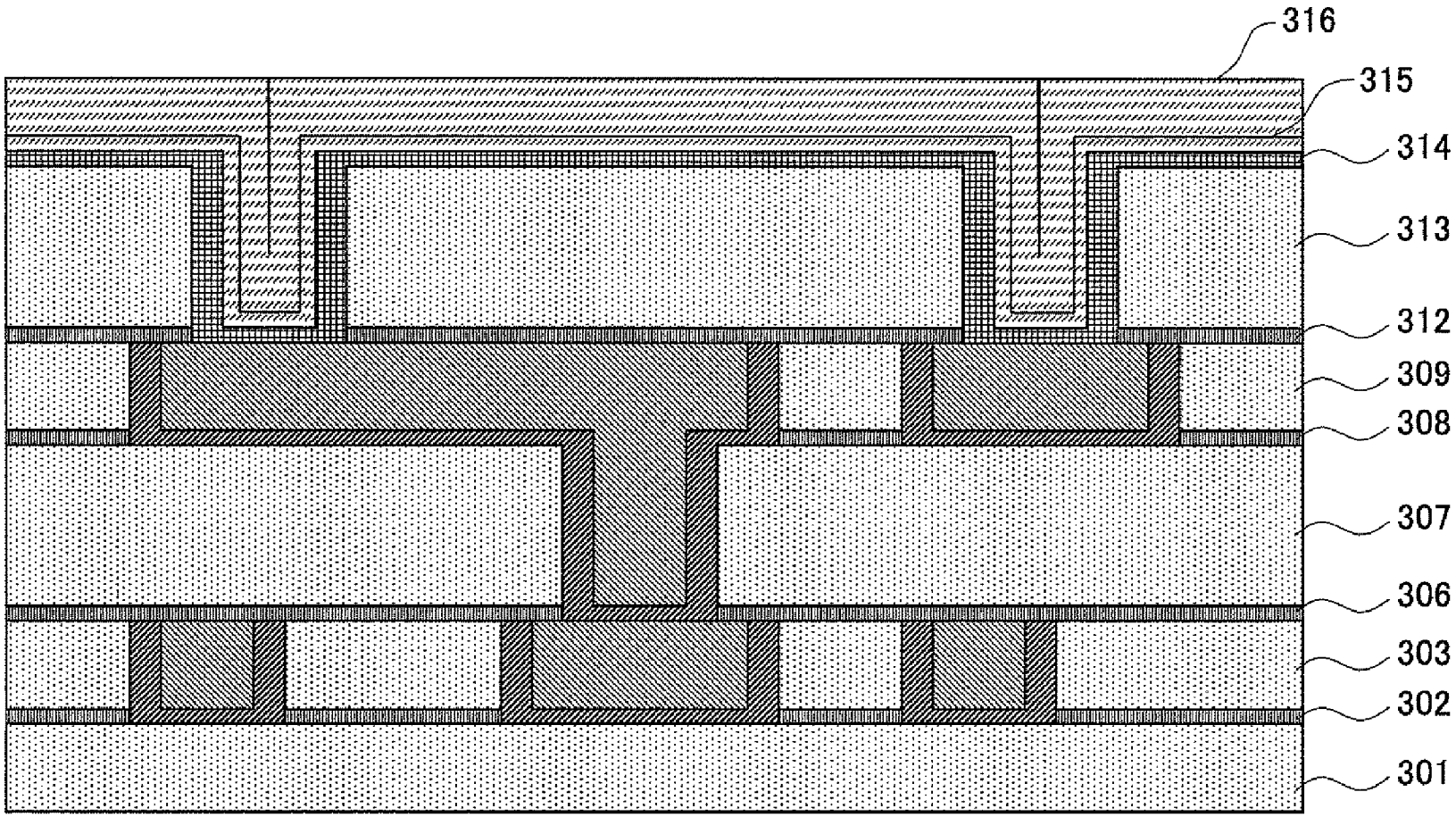

Next, in the process of FIG. 17I, a TaN barrier metal film 314 is formed over the interlayer dielectric film 313 by reactive sputtering in a manner to continuously cover the sidewall surface and bottom of each via 313V. Then, a TiN barrier metal film 315 is formed over the TaN barrier metal film 314 by reactive sputtering. In the process of FIG. 17J, a tungsten film 316 is formed by CVD so as to fill in the vias 313V.

Next, in the process of FIG. 17K, the tungsten film 316 and the TiN and TaN barrier metal films 315 and 314 disposed below the tungsten film 316 are polished and removed by CMP until the surface of the interlayer dielectric film 313 is exposed, and thereby tungsten via plugs 316W are formed in the vias 313V.

Figure 17K:
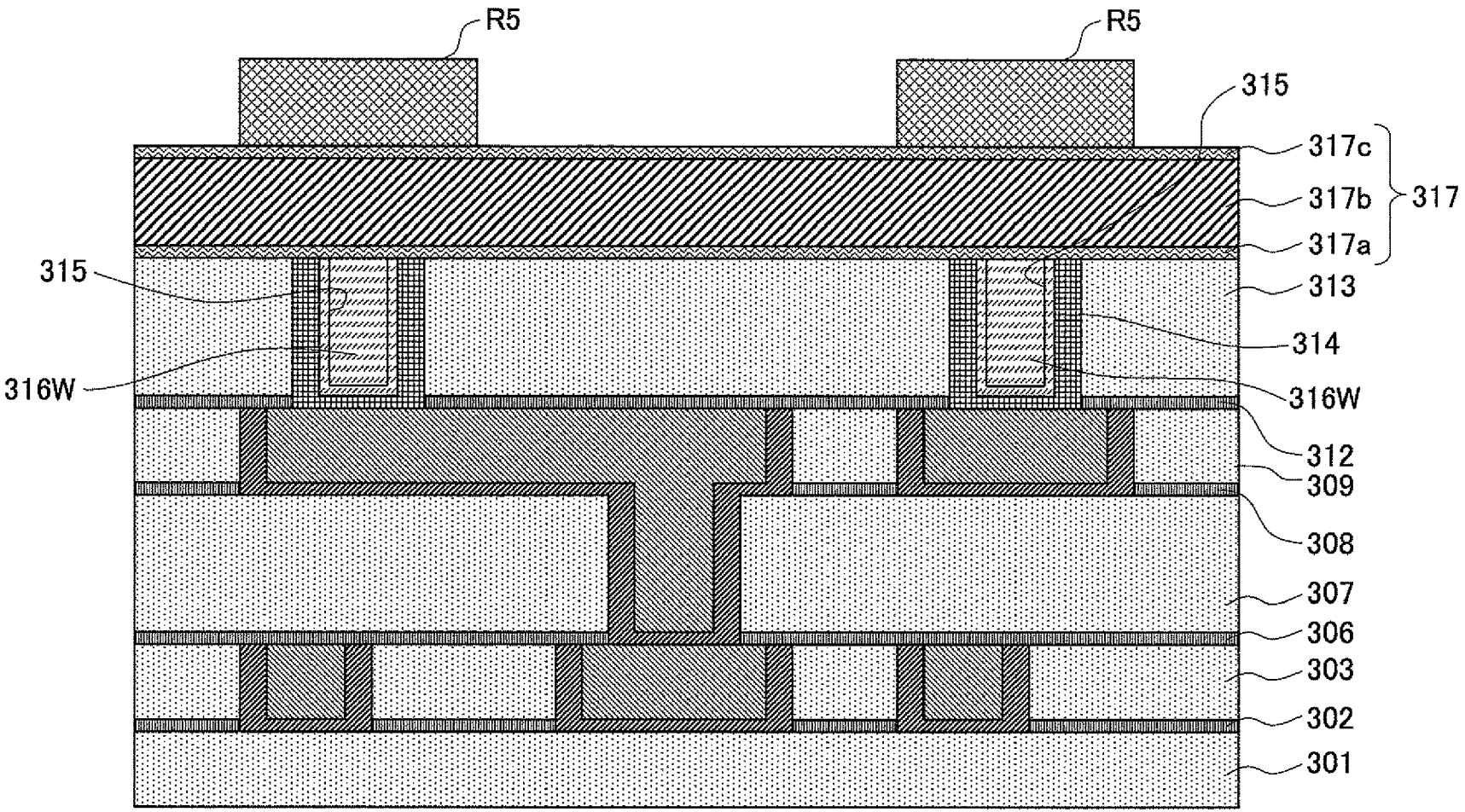

Further in the process of FIG. 17K, a TiN barrier metal film 317*a* and a conductor film 317*b* made of aluminum or an aluminum-copper alloy are sequentially formed over the interlayer dielectric film 313. Then, another TiN barrier metal film 317*c* is formed over the conductor film 317*b*. The conductor film 317*b* and the TiN barrier metal films 317*a* and 317*c* together form a wiring layer 317.

In the process of FIG. 17K, a resist pattern R5 corresponding to a wiring pattern desired to be formed is formed on the wiring layer 317. Next, in the process of FIG. 17L, a pattern is developed in the wiring layer 317 by dry etching using the resist pattern R5 as a mask, and thereby wiring pattern portions 317A and 317B are formed over the tungsten via plugs 316W.

Figure 17L:
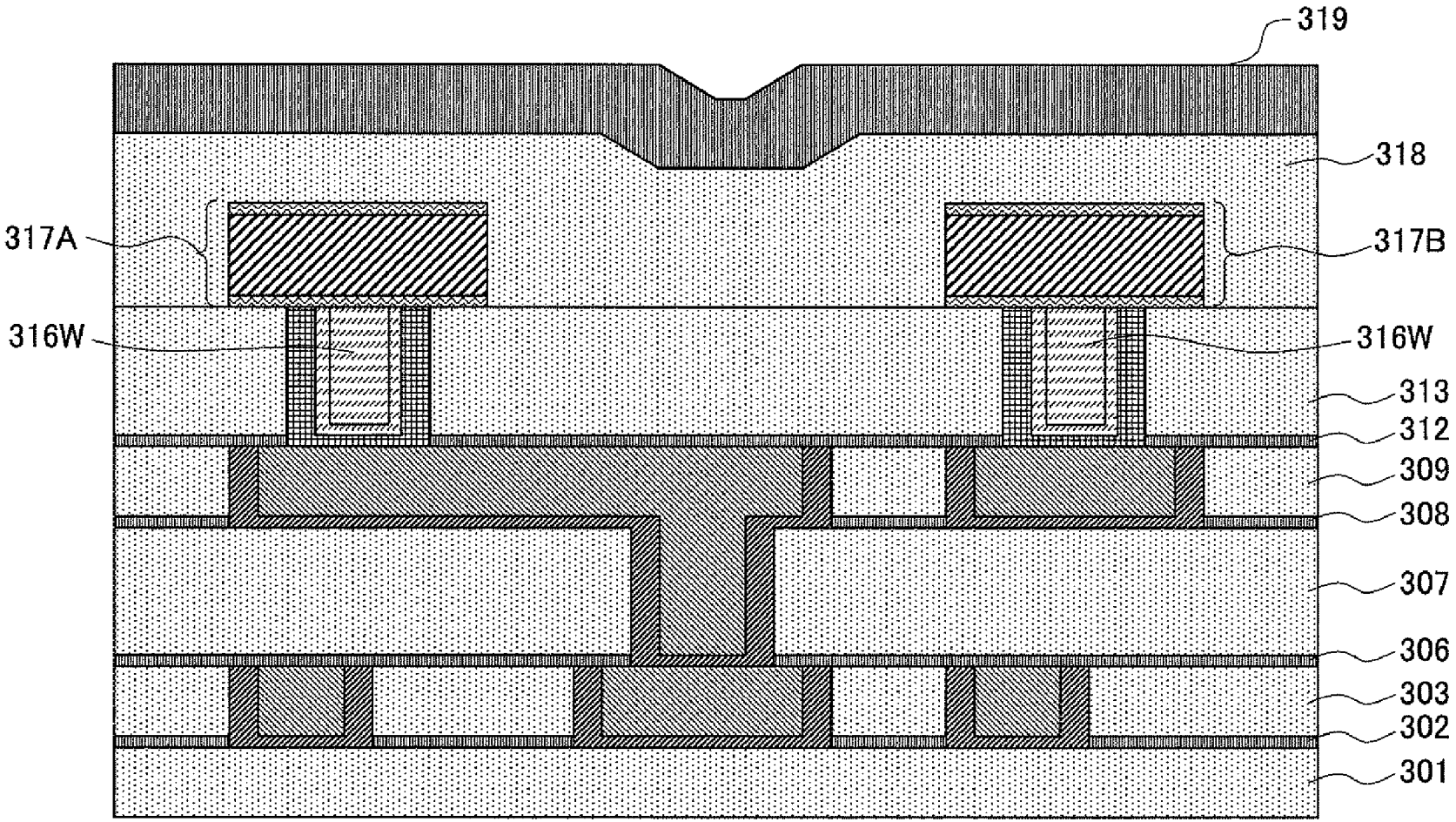

Further in the process of FIG. 17L, over the interlayer dielectric film 313, an interlayer dielectric film 318 made of, for example, $SiO_2$ is deposited so as to cover the wiring pattern portions 317A and 317B. Then, a passivation film 319 made of, for example, SiN is formed over the surface of the interlayer dielectric film 318.

In the present embodiment, the plating process of the Cu layer 305/310 in FIG. 17B/17F is performed in a manner described in reference to FIGS. 16A through 16G. Herewith, the wiring trenches can be filled such that the Cu layer 305/310 exhibits excellent in-plane uniformity. As a result, it is possible to effectively prevent the occurrence of dishing and the like in the subsequent CMP process.

(c) Third Embodiment

Figure 18:
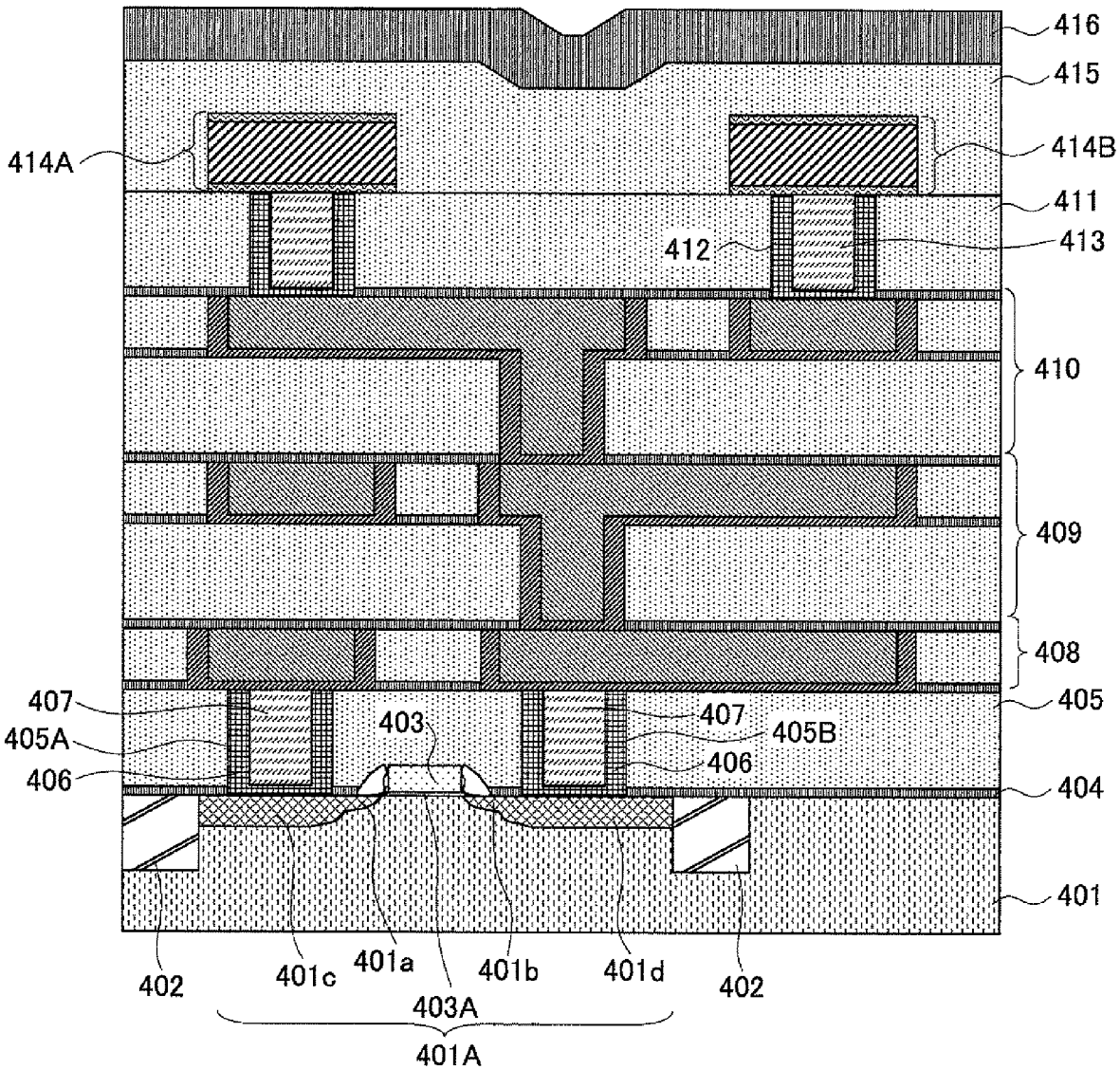
FIG. 18 shows a structure of a semiconductor device according to the third embodiment.

FIG. 18 shows a structure of a semiconductor device according to the third embodiment of the present disclosure, which has the multilayer wiring structure of the second embodiment.

In reference to FIG. 18, over a silicon substrate 401, an element region 401A is defined by STI structures 402. In the element region 401A, a gate electrode 403 is formed over the silicon substrate 401 with a gate dielectric film 403A interposed between them.

A sidewall dielectric film is formed on the sidewall surface of the gate electrode 403. Furthermore, in the silicon substrate 401, LDD regions 401*a* and 401*b* are formed on both sides of the gate electrode 403. Diffusion regions 401*c* and 401*d*, each of which forms either a source region or a drain region, are also formed within the silicon substrate 401 to be disposed outward from the sidewall dielectric film. A SiN film 404 covers the entire surface of the silicon substrate 401, except for a part on which the gate electrode 403 and the sidewall dielectric film are formed.

Over the SiN film 404, an interlayer dielectric film 405 made of, for example, $SiO_2$ is formed in a manner so as to cover the gate electrode 403 and the sidewall dielectric film. In the interlayer dielectric film 405, contact holes 405A and 405B that expose the diffusion regions 401*c* and 401*d* are formed.

The sidewall surface and bottom of each contact hole 405A/405B is covered by a barrier metal film 406 which has a layered structure including a TaN film and a TiN film. The contact holes 405A and 405B are filled with a tungsten via plug 407 with the barrier metal film 406 interposed between them.

Over the interlayer dielectric film 405, Cu wiring structures 408, 409 and 410 are sequentially formed, in each of which a Cu wiring pattern is embedded in an interlayer dielectric film using the damascene technique or dual damascene technique described in the above embodiments. Over the Cu wiring structure 410, vias whose sidewall surface and bottom are covered continuously by a barrier metal film 412 (which is a conductive nitride film formed by laminating a TaN film and a TiN film) are formed in an interlayer dielectric film 411. Conductive via plugs 413 made of tungsten are formed in the vias.

Over the interlayer dielectric film 411, wiring pattern portions 414A and 414B are formed, in each of which a conductive film made of aluminum or an aluminum alloy is sandwiched by TiN barrier metal films. Furthermore, over the interlayer dielectric film 411, an interlayer dielectric film 415 is formed to cover the wiring pattern portions 414A and 414B.

The surface of the interlayer dielectric film 415 is covered by a passivation film 416 made of, for example, SiN.

The present disclosure improves the in-plane distribution of the Cu layer which fills in fine features such as trenches or vias, whereby the Cu wiring pattern formed by a damascene or dual damascene technique has a uniform height. Herewith, it is possible to reduce variation in the characteristics of semiconductor devices having such Cu wiring patterns. In addition, the amount of the overplating in the electrolytic plating process can be reduced, whereby the amount of polishing in the CMP process can be reduced, which in turn improves the operating efficiency.

All examples and conditional language used herein are intended for pedagogical purposes to aid the reader in understanding the principles of the present disclosure and the concepts contributed by the inventor to furthering the art, and are to be construed as being without limitation to such specifically recited examples and conditions, nor does the organization of such examples in the specification relate to a showing of the superiority or inferiority of the present disclosure. Although the embodiments of the present disclosure have been described in detail, it should be understood that various changes, substitutions, and alterations could be made hereto without departing from the spirit and scope of the present disclosure.

What is claimed is:

1. An electrolytic plating method comprising:

a first layer forming step of immersing an in-process substrate in an electrolytic plating liquid including copper salt to form a first copper layer on the in-process substrate; and a second layer forming step of forming a second copper layer over the first copper layer in the electrolytic plating liquid;

wherein the first layer forming step is continued for ten seconds or less after the immersion of the in-process substrate, in the first layer forming step, the in-process substrate is rotated at a first rotational speed N in rpm which satisfies a condition of $D \times N \times \pi \leqq 6000 \times \pi$ (mm/min), where D is a diameter of the in-process substrate in mm, and $D \times N \times \pi$ represents a peripheral speed of the in-process substrate, and a plating current is supplied to the in-process substrate at a first current density of 10 $mA/cm^2$ or less, and in the second layer forming step, the in-process substrate is rotated at a second rotational speed which is higher than the first rotational speed, and the plating current is supplied to the in-process substrate at a second current density which is higher than the first current density.

2. The electrolytic plating method as claimed in claim 1, wherein the second rotational speed is five times or more the first rotational speed.

3. The electrolytic plating method as claimed in claim 1, wherein the second current density is 20 $mA/cm^2$ or less.

4. The electrolytic plating method as claimed in claim 1, further comprising a third layer forming step of, after the second layer forming step, supplying the plating current to the in-process substrate at a third current density which is higher than the second current density.

5. The electrolytic plating method as claimed in claim 4, wherein the third current density is 40 $mA/cm^2$ or more.

6. The electrolytic plating method as claimed in claim 4, wherein in the third layer forming step, the in-process substrate is rotated at the second rotational speed.

7. The electrolytic plating method as claimed in claim 4, wherein in the third layer forming step, the in-process substrate is rotated at a third rotational speed which is lower than the second rotational speed.

8. The electrolytic plating method as claimed in claim 4, wherein the third layer forming step starts upon a trench disposed on the in-process substrate and having a width twice or more a depth thereof being filled with the second copper layer.

9. A method for manufacturing a semiconductor device comprising:

forming a depression in a dielectric film disposed on an in-process substrate;

forming a barrier metal film over the dielectric film in a manner to follow a shape of the depression to continuously cover a sidewall surface and a bottom of the depression;

forming a copper seed layer in a manner to follow the shape of the depression to cover the barrier metal film;

filling the depression with a copper layer by electrolytic plating in which the copper seed layer serves as an electrode; and removing part of the copper layer by chemical mechanical polishing until a surface of the dielectric film is exposed;

wherein the electrolytic plating includes a first layer forming step of immersing the in-process substrate in an electrolytic plating liquid including copper salt to form a first copper layer on the in-process substrate, and a second layer forming step of forming a second copper layer over the first copper layer in the electrolytic plating liquid; the first layer forming step is continued for ten seconds or less after the immersion of the in-process substrate; in the first layer forming step, the in-process substrate is rotated at a first rotational speed N in rpm which satisfies a condition of $D \times N \times \pi \leqq 6000 \times \pi$ (mm/min), where D is a diameter of the in-process substrate in mm, and $D \times N \times \pi$ represents a peripheral speed of the in-process substrate, and a plating current is supplied to the in-process substrate at a first current density of 10 $mA/cm^2$ or less; and in the second layer forming step, the in-process substrate is rotated at a second rotational speed which is higher than the first rotational speed, and the plating current is supplied to the in-process substrate at a second current density which is higher than the first current density.

* * * * *